US011390425B2

(12) United States Patent
Bressan et al.

(10) Patent No.: US 11,390,425 B2
(45) Date of Patent: Jul. 19, 2022

(54) TAMPER-EVIDENT ENVELOPE, PROCESS OF MANUFACTURING OF SAID ENVELOPE AND USE THEREOF FOR CONTAINING PRODUCTS

(71) Applicant: I.G.B. S.R.L., Milan (IT)

(72) Inventors: Michel Bressan, Induno Olona (IT); Alessio Bressan, Varese (IT); Alberto Gandolla, Induno Olona (IT)

(73) Assignee: I.G.B. S.R.L., Milan (IT)

( * ) Notice: Subject to any disclaimer, the term of this patent is extended or adjusted under 35 U.S.C. 154(b) by 191 days.

(21) Appl. No.: 16/645,467

(22) PCT Filed: Aug. 21, 2018

(86) PCT No.: PCT/IB2018/056322

§ 371 (c)(1),
(2) Date: Mar. 7, 2020

(87) PCT Pub. No.: WO2019/048958

PCT Pub. Date: Mar. 14, 2019

(65) Prior Publication Data

US 2020/0277106 A1 Sep. 3, 2020

(30) Foreign Application Priority Data

Sep. 7, 2017 (IT) ..... 102017000100170

(51) Int. Cl.

| | |
|---|---|
| ***B65D 27/22*** | (2006.01) |
| ***B65D 27/34*** | (2006.01) |
| ***B65D 75/02*** | (2006.01) |

(52) U.S. Cl.

CPC ..... *B65D 27/22* (2013.01); *B65D 27/34* (2013.01); *B65D 75/02* (2013.01)

(58) Field of Classification Search

CPC ..... B65D 27/22; B65D 27/34; B65D 75/02

(Continued)

(56) References Cited

U.S. PATENT DOCUMENTS

| | | | | | |
|---|---|---|---|---|---|
| 90,663 | A * | 6/1869 | Hoffacker | ..... | B65D 27/22 229/84 |
| 548,250 | A * | 10/1895 | Foster | ..... | B65D 27/22 229/84 |

(Continued)

FOREIGN PATENT DOCUMENTS

| | | | | | |
|---|---|---|---|---|---|
| AU | 44793 | A | 1/1974 | | |
| FR | 412026 | A * | 7/1910 | ..... | B65D 27/22 |

(Continued)

*Primary Examiner* — Jes F Pascua

(57) ABSTRACT

The present invention relates to a tamper-evident envelope element (1) of sheet material comprising: a rear wall (2), a first and a second front flap engaged with the rear wall (2) opposite to each other. The first and second front flaps (3, 4) are configured for defining a closed condition in which they partially overlap each other, and an open condition in which they are distanced from each other. The envelope 1 comprises a safety device (12) having a first coupling portion (13) borne by the first front flap (3), a second coupling portion (14) borne by the second front flap (4). The first and the second coupling portion (13, 14) are configured to engage stably with each other during first closed condition of the first and second front flap (3, 4); at least one between the first and second coupling portions (13, 14) has at least one removable portion (15) configured for separating from at least one between the first and second front flap after a first opening condition thereof subsequent to said first closed condition for preventing a subsequent coupling of said first and second coupling portion (13, 14). The present invention also relates to a process for manufacturing said element.

18 Claims, 11 Drawing Sheets

(58) Field of Classification Search
USPC ..... 229/80, 82, 84
See application file for complete search history.

(56) References Cited

U.S. PATENT DOCUMENTS

| | | | | | |
|---|---|---|---|---|---|
| 598,359 | A | * | 2/1898 | Butzer | B65D 27/00 229/75 |
| 758,379 | A | * | 4/1904 | Noseworthy | B65D 27/00 229/75 |
| 838,964 | A | * | 12/1906 | Dobson et al. | B65D 27/22 229/84 |
| 1,047,515 | A | * | 12/1912 | Grampp et al. | B65D 27/30 229/81 |
| 1,159,686 | A | * | 11/1915 | Kojima | B65D 27/30 229/82 |
| 1,249,951 | A | * | 12/1917 | Gustafson | B65D 27/22 229/84 |
| 1,307,447 | A | | 6/1919 | Klotz et al. | |
| 1,391,493 | A | * | 9/1921 | Pachko | B65D 27/30 229/84 |
| 2,268,845 | A | | 1/1942 | Powers | |

FOREIGN PATENT DOCUMENTS

| | | | |
|---|---|---|---|
| GB | 234710 | A | 6/1925 |
| WO | 2015170203 | A1 | 11/2015 |

* cited by examiner

TAMPER-EVIDENT ENVELOPE, PROCESS OF MANUFACTURING OF SAID ENVELOPE AND USE THEREOF FOR CONTAINING PRODUCTS

FIELD OF THE INVENTION

The present invention relates to a tamper-evident envelope and a process for manufacturing it. The present invention further relates to a use of the tamper-evident envelope for containing products of various kinds. The envelope can find application in the sectors of communication, for example for postal services, of transport and of logistics; in particular, the present invention can find application in all sectors entailing the packing of products and in which security is required to allow making evident any tampering with the envelope.

BACKGROUND OF THE INVENTION

Today, envelopes made of paper or plastic material for sending—via post or by hand—letters, documents, items of various kinds. Usually, the envelopes are used to send confidential items and documents; therefore, it is useful to guarantee to the recipient that the content of the envelope—after it is sent by the sender—has not been violated. For this purpose, paper envelopes are used that have a main body for housing the items and a flap for closing the envelope; the closing flap has a strip of glue usable to fasten the main body so as to stably close the envelope. However, it is observed that the presence of the strip of glue does not allow defining a secure closure of the envelope. These envelope in fact are easily tampered with by simply heating the closing flap that allows its unsticking and hence its separation from the main body without causing visible damages; the envelope can then be easily closed again by applying a new strip of glue without any evidence to the recipient that the envelope has been tampered with.

Therefore, use has become widespread of envelopes, made of paper or plastic, provided with security systems configured to give evidence of tampering with the envelope itself. These envelopes, defined "tamper-evident", are configured to allow the insertion and closure of items within them and, as a result of a condition of first opening of the package, to give evidence thereof. For example, envelopes made of plastic material are known that use, as "tamper-evident" systems, adhesive labels positioned on the closure of the envelope and configured to prevent its opening without the previous removal of the label. However, these envelopes certainly have a higher cost than the aforementioned traditional envelopes because they need additional raw materials represented by the seals/labels and additional steps for the arrangement and application of these elements. These adhesive labels also do not allow making the envelopes tamper-proof, as labels can easily be removed by unsticking them: following the opening of the envelope, it is possible to tamper with the content and reposition the same label that was removed, or a new label, on the closure flap without any evidence to the recipient that the envelope has been tampered with.

An additional solution is described in patent application no. AU 44793 72 A relating to an envelope made of sheet material consisting of a central portion from which peripherally emerge a lower sheet, an upper sheet opposite to the lower sheet and two lateral sheets that are also positioned opposite each other with respect to the central portion. The lower sheet bears a pocket configured to receive in insertion and engage, during a folded condition of the envelope, a coupling portion borne by the upper sheet. The coupling portion comprises head tab from which emerge two lateral tabs opposite each other with respect to the same head tab; the lateral tabs are connected to the head tab by creasing adapted to allow folding the lateral tab to facilitate its insertion in the pocket of the upper sheet. The entire coupling portion is connected to the remaining part of the upper sheet by a weakened element configured to allow the detachment of said coupling portion during a step of opening the envelope.

The Applicant has observed that the envelopes used today for sending items, while widely used, have closing systems that can easily be bypassed and are incapable of providing effective evidence of any tampering with the envelope.

PURPOSE OF THE INVENTION

A purpose of the present invention, therefore, is to solve substantially at least one of the drawbacks and/or limitations of the previous solutions.

A first objective of the invention is to make available an envelope that can effectively assure that evidence of tampering is given upon a first opening thereof; in particular, a purpose of the invention is to make available a tamper-evident envelope that has a tamper-evident security system that is easy to arm (activate) at first closing of the same envelope. An additional purpose of the invention is to make available an envelope that is simple and rapid to manufacture, which allows to minimize production and product cost.

One or more of the purposes described below and that will become more readily apparent in the description that follows are substantially achieved by a tamper-evident envelope, a process for its manufacture and a use of the same element in accordance with one or more of the accompanying claims and/or of the following aspects, taken alone or in any combination with each other or in combination with any of the accompanying claims and/or in combination with any of the additional aspects or characteristics described below.

SUMMARY

In a 1$^{st}$ aspect, a tamper-evident envelope element (1) is provided, in particular an envelope (1), of sheet material comprising:

- at least one rear wall (2),
- at least a first front flap (3) engaged with the rear wall (2), optionally at a perimetral edge (5) thereof,
- at least a second front flap (4) also engaged with the rear wall (2), optionally at the perimetral edge (5) thereof, and opposite to said first front flap (3), wherein the first and second front flaps (3, 4) are configured for defining at least one closed condition wherein they overlap each other at least partially, optionally substantially facing the rear wall (2) and at least partially in contact with each other, wherein the first and second front flaps (3, 4) are also configured for defining at least one open condition wherein they are distanced from each other, the envelope element, in particular the envelope (1), comprises at least one safety device (12) of sheet material, said safety device (12) comprising:

- at least one first coupling portion (13) borne by the first front flap (3),
- at least one second coupling portion (14) borne by the second front flap (4), the first and second coupling portions (13, 14) being configured for stably engaging with each other during a first closed condition of the first and second front flaps (3, 4), at least one between the first and second coupling portions (13, 14) having at least one removable portion (15) configured for separating from at least one between said first and second front flap upon a first open condition thereof after said first closed condition for preventing a following coupling of said first and second coupling portions (13, 14) and for revealing a tampering of the envelope element (1), in particular of the envelope (1).

In a $2^{nd}$ aspect a tamper-evident band element (100) is provided, in particular a band (100), of sheet material comprising:

at least one rear wall (2), at least one first front flap (3) engaged with the rear wall (2), optionally at a perimetral edge (5) of this latter, at least a second front flap (4) also engaged with the rear wall (2), optionally at the perimetral edge (5) thereof, opposite to said first front flap (3), wherein the first and second front flaps (3, 4) are configured for defining at least one closed condition wherein these latter overlap, and optionally are at least partially in contact with each other, wherein the first and second front flaps (3, 4) are further configured for defining at least one open condition, wherein these latter are distanced from each other, the band element, in particular the band (100), comprises at least one safety device (12) of sheet material, said safety device (12) comprising:

at least one first coupling portion (13) borne by the first front flap (3), at least one second coupling portion (14) borne by the second front flap (4), the first and second coupling portions (13, 14) being configured for stably engaging with each other during a first closed condition of the first and second front flaps (3, 4), at least one between the first and second coupling portions (13, 14) having at least one removable portion (15) configured for separating from at least one between said first and second front flap upon a first open condition thereof after said first closed condition for preventing a following coupling of said first and second coupling portions (13, 14) and for revealing a tampering of the envelope element (1), in particular of the envelope (1).

In a $3^{rd}$ aspect, a tamper-evident container element is provided, in particular a container, of sheet material comprising:

at least one rear wall (2), at least a first front flap (3) engaged with the rear wall (2) at a perimetral edge (5) thereof, at least a second front flap (4) also engaged with the rear wall (2), optionally at the perimetral edge (5) thereof, opposite to said first front flap (3), wherein the first and second front flaps (3, 4) are configured for defining at least one closed condition wherein they overlap each other at least partially, optionally substantially facing the rear wall (2) and at least partially in contact with each other, wherein the first and second front flaps (3, 4) are also configured for defining at least one open condition wherein they are distanced from each other, the container element, in particular the container, comprises at least one safety device (12) of sheet material, said safety device (12) comprising:

at least one first coupling portion (13) borne by the first front flap (3), at least one second coupling portion (14) borne by the second front flap (4), the first and second coupling portions (13, 14) being configured for stably engaging with each other during a first closed condition of the first and second front flaps (3, 4), at least one between the first and second coupling portions (13, 14) having at least one removable portion (15) configured for separating from at least one between said first and second front flap upon a first open condition thereof after said first closed condition for preventing a following coupling of said first and second coupling portions (13, 14) and for revealing a tampering of the container element (1), in particular of the container (1).

In a $4^{th}$ aspect in accordance with any of the preceding aspects the first coupling portion (13) is joined in a single piece to the first front flap (3).

In a $5^{th}$ aspect in accordance with any of the preceding aspects the second coupling portion (14) is joined in a single piece to the second front flap (4).

In a $6^{th}$ aspect according to any of the preceding aspects wherein at least one between said first and second front flaps (3, 4) is rotatively movable with respect to the rear wall (2) at least between:

the closed condition wherein the at least one between said first and second front flaps (3, 4) substantially faces the rear wall (2), the open condition wherein the at least one between said first and second front flaps (3, 4) is distanced from the other between said second and first front flaps.

In a $7^{th}$ aspect according to any of the preceding aspects, the first and second front flaps (3, 4) are both rotatively movable with respect to the rear wall (2) at least between the closed condition and the open one.

In an $8^{th}$ aspect according to any of the preceding aspects, the rear wall (2) substantially extends along a prevalent development plane.

In a $9^{th}$ aspect according to any of the preceding aspects wherein the at least one between said first and second front flap (3, 4) is movable by rotation relative to the rear wall (2) around an axis lying the prevailing plane of development of the rear wall (2), optionally both front flaps (3, 4) are movable by rotation relative to the rear wall (2) around a respective axis lying in the prevailing plane of development of the rear wall (2).

In a $10^{th}$ aspect according to any of the preceding aspects, the rear wall (2) of sheet material extends in thickness between a first and second surfaces, wherein the first and second front flaps (3, 4)—under the closed condition—both face the first surface of the rear wall.

In an $11^{th}$ aspects according to the preceding aspect in which—in the closed condition of the first and second front flap—the first surface of the rear wall essentially defines an inner surface of the element (in particular of the envelope element or of the band element or of the container element) while the second surface defines an outer surface of the same element.

In a $12^{th}$ aspect according to any of the preceding aspects, the first front flap (3) extends from the rear wall from the perimetral edge (5) of the latter wall (2) to a top portion (3*a*) of the first front flap (3) distanced from said perimetral edge, wherein the first coupling portion (13) is positioned at said top portion (3*a*) of the first flap.

In a $13^{th}$ aspect according to any of the preceding aspects, the first coupling portion (13) defines a part of an outer delimitation perimeter of the first front flap (3).

In a $14^{th}$ aspect according to any of the preceding aspects, the second front flap (4) extends from the rear wall (2) from the perimetral edge (5) of the latter wall to a top portion (4*a*) of the second front flap (4) distanced from said perimetral edge (5), wherein the second coupling portion (14) is disposed at said top portion (4*a*) of the second flap (4).

In a 15$^{th}$ aspect according to the preceding aspect in which—in the first closed condition of the first and second front flaps (3, 4)—the respective top portions (3*a*, 4*a*) of said front flaps are configured for overlapping each other and enabling the engagement of the first and second coupling portions (13, 14).

In a 16$^{th}$ aspect according to any of the preceding aspects, the second coupling portion (14) faces and is at least partly in contact with the second front flap (4).

In a 17$^{th}$ aspect according to any of the preceding aspects, the second coupling portion overlaps the second front flap (4).

In an 18$^{th}$ aspect according to any of the preceding aspects, the second front flap (4) of sheet material extends in thickness between a first and second surface, wherein the second coupling portion (14) is at least partly engaged to the first surface of the second front flap (4) at the top portion thereof.

In a 19$^{th}$ aspect according to the preceding aspect, the second coupling portion (14) is glued to the first surface of the second front flap (4).

In a 20$^{th}$ aspect according to any of the preceding aspects, the second coupling portion (14) is side by side and at least partly in contact with the second frontal flap (4), in particular with the first surface of the second front flap (4).

In a 21$^{th}$ aspect according to any of the aspects from the eighteenth to the twentieth, the first surface of the second front flap (4) extends in prolongation, seamlessly, to the first surface of the rear wall (2), wherein the second surface of the second front flap (4) extends in prolongation, seamlessly, to the second surface of the rear wall (2).

In a 22$^{nd}$ aspect according to any of the aspects from the eighteenth to the twenty-first, the first surfaces of the rear wall (2) and of the second front flap (4) are—in the closed condition of the first and second flap—at least partly facing each other.

In a 23$^{rd}$ aspect according to any of the preceding aspects, the first front flap (3) of sheet material extends in thickness between a first and a second surface, the first surface of the first front flap (3) extends in prolongation, seamlessly, to the first surface of the rear wall (2), wherein the second surface of the first front flap (3) extends in prolongation, seamlessly, to the second surface of the rear wall (2).

In a 24$^{th}$ aspect according to the preceding aspect, the first surfaces respectively from the rear wall (2) of the first front flap (3) are—in the closed condition—facing each other.

In a 25$^{th}$ aspect according to any of the preceding aspects, the first coupling portion (13) is an extension of the first front flap (3).

In a 26$^{th}$ aspect according to any of the preceding aspects, the first coupling portion extends in prolongation, seamlessly, to the first front flap (3).

In a 27$^{th}$ aspect according to any of the aspects from the 23$^{rd}$ to the 26$^{th}$, the first coupling portion (13) of sheet material of the safety device (12) extends in thickness between a first and a second surface, wherein the first surface of the first front flap (3) extends in prolongation, seamlessly, to the first surface of the first coupling portion (13), wherein the second surface of the first front flap (3) extends in prolongation, seamlessly, to the second surface of the first coupling portion (13).

In a 28$^{th}$ aspect according to any of the preceding aspects, wherein—at least in the open condition—the first front flap (3) is directly interposed between the rear wall (2) and the first coupling portion (13).

In a 29$^{th}$ aspect according to any of the preceding aspects, further comprising:

at least one first lateral flap (6) engaged with the rear wall (2), optionally at the perimetral edge (5) thereof, adjacently the first and the second front flaps, in particular between said first and second front flaps, at least one second lateral flap (7) engaged with the rear wall (2), optionally at the perimetral edge (5) thereof, opposite to the first lateral flap (6) and adjacently the first and second front flaps, in particular between said first and second front flaps, the first and the second lateral flap (6, 7) being configured to be arranged—in the closed condition of the first and second front flap (3, 4)—interposed between the rear wall (2) and said first and second front flap (3, 4).

In a 30$^{th}$ aspect in accordance with the preceding aspect, the first and the second lateral flap (6, 7)—at least in the closed condition of the first and second front flap (3, 4)—extend in prolongation starting from the rear wall (2) towards each other.

In a 31$^{st}$ aspect according to the 29$^{th}$ or 30$^{th}$ aspect, the rear wall (2) exhibits a square or rectangular shape, the perimetral edge (5) of the rear wall is defined by a first and second longitudinal edges (2*a*, 2*b*) distanced and parallel to each other, which are connected to the first and second transverse edges (2*c*, 2*d*), said first and second transverse edges are also distanced and parallel to each other, wherein the first front flap (3) is directly connected, particularly is integral with, to the first transverse edge (2*c*), while the second front flap (4) is connected to the second transversal edge (2*d*), wherein the first lateral flap (6) is connected to the first longitudinal flap (2*a*) while the second lateral flap (7) is connected to the second longitudinal edge (2*b*).

In a 32$^{nd}$ aspect in accordance with the preceding aspect, the rear wall (2) has a pre-set length defined essentially by the distance between the first and the second transverse edge (2*c*, 2*d*), wherein the first and the second front flap (3, 4) have respective lengths measured orthogonally to the first transverse edge (2*c*), wherein the sum of the lengths of the first and second front flap (3, 4) is greater than the total length of the rear wall (2).

In a 33$^{rd}$ aspect according to the 31$^{st}$ or 32$^{nd}$ aspect, the rear wall (2) has a pre-set length defined essentially by the distance between the first and the second transverse edge (2*a*, 2*b*), the first and the second lateral flap (6, 7) have respective lengths measured orthogonally to the first longitudinal edge (2*a*), wherein the ratio between the sum of the lengths of the first and second lateral flap (6, 7) and the width of the rear wall (2) is between 0.3 and 1.5, in particular between 0.5 and 1.3, even more in particular between 0.8 and 1.2.

In a 34$^{th}$ aspect according to any of the aspects from the 31$^{st}$ to the 33$^{rd}$, the first front flap (3) has an essentially rectangular or square shape wherein a side of said first front flap (3) coincides with the first transverse edge (2*c*) of the rear wall (2).

In a 35$^{th}$ aspect according to any of the aspects from the 31$^{st}$ to the 34$^{th}$, the second front flap (4) has an essentially rectangular or square shape wherein a side of said second front flap (4) coincides with the second transverse edge (2*d*) of the rear wall (2).

In a 36$^{th}$ aspect according to any of the aspects from the 31$^{st}$ to the 35$^{th}$, the first lateral flap (6) has an essentially rectangular or square shape wherein a side of said first lateral flap (6) coincides with the first longitudinal edge (2*a*) of the rear wall (2).

In a 37$^{th}$ aspect according to any of the aspects from the 31$^{st}$ to the 36$^{th}$, the second lateral flap (7) also has an essentially rectangular or square shape wherein a side of said second lateral flap (7) coincides with the second longitudinal edge (2*b*) of the rear wall (2).

In a 38$^{th}$ aspect according to any of the aspects from the 29$^{th}$ to the 37$^{th}$ at least one between said first and second lateral flap (6, 7) is rotatively movable with respect to the rear wall (2), optionally the first and the second lateral flap (6, 7) are both rotatively movable with respect to the rear wall (2).

In a 39$^{th}$ aspect according to any of the aspects from the 29$^{th}$ to the 38$^{th}$\, at least one between said first and second lateral flaps (6, 7) is rotatively movable with respect to the rear wall (2) about an axis lying in the prevalent development plane of the rear wall (2), optionally both the lateral flaps (6, 7) are rotatively movable with respect to the rear wall (2) about a respective axis lying in the prevalent development plane of the rear wall (2).

In a 40$^{th}$ aspect according to any of the preceding aspects, the first coupling portion (13)—at least in the closed condition of the first and second front flaps (3, 4)—is at least partially interposed between the second coupling portion (14) and said second front flap (4).

In a 41$^{st}$ aspect according to any of the preceding aspects, the removable portion (15), defined on at least one between the first and the second coupling portion (13, 14) comprises at least one first undercut portion defining essentially a coupling edge adapted to receive in engagement the other one between said second and/or first coupling portion (14, 13).

In a 42$^{nd}$ aspect according to any of the preceding aspects, the second coupling portion (14) comprises at least one hook (22) defining at least one undercut portion delimited by a gripping edge (22*a*), wherein the first wherein the first coupling portion (13) comprises at least one respective hook (23) defining at least one undercut portion delimited by a respective gripping edge (23*a*), said hooks (22, 23), respectively of the first and second coupling portion (13, 14), being configured to engage stably to each other at least during the condition of first closing of the first and second front flap.

In a 43$^{rd}$ aspect according to any of the preceding aspects, the hooks (23, 22) respectively of the first and second coupling portion (13, 14)—in the first closed condition of the first and second front flap—having respective mutually facing concavities.

In a 44$^{th}$ aspect according to the 42$^{nd}$ or 43$^{rd}$ aspect, the first coupling portion (13) comprises at least one pair of said undercut portions delimited by a respective pair of said gripping edges (23*a*) and defining two respective hooks (23), said hooks (23) of the first coupling portion (13)—in the armed condition—being configured to engage with the hook (22) of the second coupling portion (14).

In a 45$^{th}$ aspect according to any of the aspects from the 42$^{nd}$ to the 44$^{th}$, the second coupling portion (14) comprising a single undercut portion to define a single hook (22).

In a 46$^{th}$ aspect according to any of the aspects from the 42$^{nd}$ to the 45$^{th}$, the second coupling portion (14) comprising a base body (25) which directly bears the hook (22) of the same second coupling portion (14), said hook (22) of the second coupling portion (14) being rotatively movable with respect to said base body (25).

In a 47$^{th}$ aspect according to the preceding aspect wherein only the base body (25) of the second coupling portion (14) is directly constrained, for example by gluing, to the second front flap (4).

In a 48$^{th}$ aspect according to any of the preceding aspects, the removable portion (15) is defined by at least one part of the second coupling portion (14).

In a 49$^{th}$ aspect according to any of the aspects from the 42$^{nd}$ to the 48$^{th}$, the removable portion (15) is defined by the hook (22) of the second coupling portion (14).

In a 50$^{th}$ aspect according to the preceding aspect, the second coupling portion (14) comprises a weakening element (26) delimiting the hook (22) of the same second coupling portion (14) which defines said removable portion (15).

In a 51$^{st}$ aspect according to any of the aspects from the 46$^{th}$ to the 50$^{th}$, the second coupling portion (14) has a weakening, optionally a weakening element, between the base body (25) and the hook (22) so that said hook (22) can define said removable portion (15).

In a 52$^{nd}$ aspect according to any of the aspects from the 1$^{st}$ to the 47$^{th}$, the removable portion (15) is defined by at least one part of the second coupling portion (13).

In a 53$^{rd}$ aspect according to the preceding aspect, the removable portion (15) is defined by the hook (23) of the first coupling portion (13).

In a 54$^{th}$ aspect according to the 51$^{st}$ or 52$^{nd}$ or 53$^{rd}$ aspect, the first coupling portion (13) comprises a weakening element (26) delimiting the hook (23) of the same first coupling portion (13) which defines said removable portion (15), optionally the first coupling portion (13) has a weakening element (26) between a base body and the hook (23) so that the latter can define said removable portion (15).

In a 55$^{th}$ aspect according to any of the aspects from the 50$^{th}$ to the 54$^{th}$, the weakening portion (26) of the first or second coupling portion (13, 14) comprises at least one selected from: one or more cuts through the sheet material, a die-cut of the sheet material, a local compression of the sheet material.

In a 56$^{th}$ aspect according to any of the preceding aspects, the element (optionally the envelope element or the container element) comprises at least one of:

- a through opening (28) defined on the first front flap (3) which is configured—under the first closed condition of the first and second front flaps—for enabling to display the removable portion (15),
- a cavity (29) defined on the second front flap (4) which is configured—under the first closed condition of the first and second front flaps—for enabling to display the removable portion (15).

In a 57$^{th}$ aspect according to the preceding aspect, the through opening (28), in the first closed condition of the first and second front flap, is positioned at the cavity (29).

In a 58$^{th}$ aspect according to the 56$^{th}$ or 57$^{th}$ aspect, the cavity (29) and the through opening (28) face each other.

In a 59$^{th}$ aspect according to the any of the aspects from 56$^{th}$ to the 58$^{th}$, the through opening (29), in the first closed condition of the first and second front flap, are at least partly mutually counter-shaped and allow the display of the removable portion (15).

In a 60$^{th}$ aspect according to any of the preceding aspects, the element (optionally, the envelope element or the band element or the container element) comprises at least one support portion (16) directly constrained to at least one between the second front flap (4) and the second coupling portion (14), wherein the wherein the support portion (16) is configured—at least during an initial contact step between the first and second coupling portions (13, 14) before said first closed condition of the first and second front flaps—for supporting at least part of said second coupling portion (14).

In a 61st aspect according to the preceding aspect, the support portion (16) comprises a mutual coupling portion (17) overlapping and stably constrained to at least a respective mutual coupling portion (18) of at least one selected between the second front flap (4) and the second coupling portion (14).

In a 62nd aspect according to the 60th or 61st aspect, the support portion (16) is directly constrained, for example by gluing, to the first surface of the second front flap (4).

In a 63rd aspect according to the 61st or the 62nd aspect, the support portion (16) comprises a thrust portion (19) emerging from the mutual coupling portion (17) of the same support portion (16), said thrust portion (19) being configured to receive in abutment, to support it, the second coupling portion (14).

In a 64th aspect according to the preceding aspect, the thrust portion (19) is movable, in particular by rotation, with respect to the mutual coupling portion (17) of the same support portion (16).

In a 65th aspect according to the 63rd or 64th aspect, the thrust portion (19) is not directly constrained to the first coupling portion (13), to the second coupling portion (14), to the first front flap and to the second front flap.

In a 66th aspect according to any of the aspects from the 63rd to the 65th, the thrust portion (19) and the mutual coupling portion (17) of the support portion (16) are joined in a single piece to define a tab of sheet material.

In a 67th aspect according to any of the aspects from the 62nd to the 65th, the mutual coupling portion (17) of the support portion (16) is defined at a bottom area (20) of the support portion (16), the thrust portion (19) emerging from the bottom portion (20) along a longitudinal development trajectory of the support portion (16), optionally the longitudinal development trajectory being a centreline of the support portion (16) itself.

In a 68th aspect according to any of the aspects from the 61st to the 67th, the support portion (16) comprises at least two of said mutual coupling portions (17) positioned essentially at longitudinally opposite end portions of the same support portion (16).

In a 69th aspect according to the preceding aspect, the two mutual coupling portions (17) extend symmetrically with respect to the longitudinal development trajectory.

In a 70th aspect according to any of the aspects from the 63rd to the 69th, the thrust portion (19) of the support portion (16) extends symmetrically with respect to the longitudinal development trajectory.

In a 71st aspect according to any of the aspects from the 61st to the 70th, the mutual coupling portion (17), optionally each mutual coupling portion, of the support portion (16) is fixed by means of adhesive material, in particular it is glued, to at least one between the first front flap (4) and the second coupling portion (14).

In a 72nd aspect according to any of the aspects from the 61st to the 71st, the mutual coupling portion (17) of the support portion (16) is solely and directly engaged, in particular glued, to the second front flap.

In a 73rd aspect according to any of the aspects from the 60th to the 72nd, the support portion (16) is joined in a single piece to the second coupling portion (14).

In a 74th aspect according to any of the preceding aspects, the first front flap, the second front flap, the first coupling portion, the second coupling portion and the rear wall are joined in a single piece to define a single sheet.

In a 75th aspect according to any of the aspects from the 60th to the 74th the second coupling portion (14) is interposed—at least during the first closed condition of the first and second front flap—between the second front flap and the support portion (16).

In a 76th aspect according to any of the aspects from the 60th to the 75th, the second coupling portion (14), the second front flap and the support portion (16) are obtained by the folding of a single sheet, in particular made of paper material.

In a 77th aspect according to any of the aspects from the 60th to the 76th, the support portion (16) comprises a weakening portion (24) configured to allow the support portion (16) to define at least the following operative conditions:

- a holding operative condition—defined during an initial step of the first closed condition of the first and second front flaps, during which the first coupling portion (13) abuts on the second coupling portion (14)—wherein the weakening portion (24) is intact and enables the support portion (16) itself to support the second coupling portion (14) by limiting the movement thereof,
- a releasing operative condition—defined at least during the first closed condition of the first and second front flaps—wherein the weakening portion is broken so that the support portion (16) can enable a movement of the second coupling portion (14) greater than the movement enabled under the holding operative condition, said weakening portion (24) being configured for enabling the support portion (16) to switch from the holding condition to the releasing one when the first closed condition of the first and second front flaps (3, 4) is defined, in other words during the engagement condition of the first and second coupling portions.

In a 78th aspect according to the preceding aspect, the support portion (16), during the holding operative condition, exerts a thrust on the second coupling portion (14) to increase rigidity against flexion.

In a 79th aspect according to the 77th or 78th aspect, the support portion (16)—during the holding operative condition—is configured to receive in abutment at least the hook (22) of the second coupling portion (14), to limit a rotation of said hook (22) approaching the support portion (16) itself.

In an 80th aspect according to any of the aspects from the 77th to the 79th, the support portion (16), during the holding operative condition—is configured to allow an angular displacement of the hook (22) of the second coupling portion (14) that is smaller than 90°, in particular contained between 0° and 70°, still more in particular contained between 0° and 45°; said angular displacement being understood as the relative rotation of the hook (22) considered between an initial position of the hook (22)—previously the holding operative condition—essentially aligned with the base body (25) and a final position that said hook (22) can assume in the holding operative condition.

In an 81st aspect according to any of the aspects from the 77th to the 80th, the support portion (16), during the release operative condition—is configured to allow an angular displacement of the hook (22) of the second coupling portion (14) that is greater than the angular displacement allowed during the holding operative condition.

In an 82nd aspect according to any of the aspects from the 77th to the 81st, the support portion (16), is configured to contrast the flexion of at least part of the second coupling portion (14) during the holding operative condition, in particular during the step of engagement between the first and the second coupling portion (13, 14), in particular the support portion (16) is configured to contrast the flexion of the hook (22) of the second coupling portion (14) during the holding operative condition.

In an 83rd aspect according to any of the preceding aspects, the element (optionally the envelope element or the band element or the container element) is entirely made of paper sheet material.

In an 84th aspect according to any of the preceding aspects, the rear wall, the first front flap and the second front flap define a single piece body configured to bend in the closed condition of the first and second flap and allow at least the partial overlapping of the latter flaps.

In an 85th aspect according to any of the preceding aspects, the band element comprises exclusively the rear wall, the first front flap and the second front flap, optionally the band element does not have the first and the second lateral flap.

In an 86th aspect according to any of the aspects from the 3rd to the 85th, wherein the first front flap (3) of the container element—at least in the closed condition—defines:

a first portion folded with respect to the rear wall (2), a second portion folded with respect to the first folded portion, wherein the second folded portion directly bears the first coupling portion (13), the first folded portion being configured to move the second folded portion away from the rear wall to define essentially a lateral wall of the container element.

In an 87th aspect according to any of the aspects from the 3rd to the 86th, wherein the second front flap (4) of the container element—at least in the closed condition—defines:

a first portion of the second front flap (4) folded with respect to the rear wall (2), a first portion of the second front flap (4) folded with respect to the first folded portion, wherein the second folded portion of the second front flap (4) directly bears the second coupling portion (14), the first folded portion of the second front flap (4) being configured to move the second folded portion away from the rear wall to define essentially a lateral wall of the second front flap (4) of the container element.

In an 88th aspect according to any of the aspects from the 29th to the 87th, wherein the first front flap (6) of the container element—at least in the closed condition—defines:

a first portion of the first front flap (6) folded with respect to the rear wall (2), a second portion of the first lateral flap (6) folded with respect to the first folded portion, wherein the second folded portion of the first lateral flap (6) is configured to move the second folded portion away from the rear wall to define essentially a lateral wall of the first lateral flap (6) of the container element.

In an 89th aspect according to any of the aspects from the 29th to the 88th, wherein the second lateral flap (7) of the container element—at least in the closed condition—defines:

a first portion of the second lateral flap (7) folded with respect to the rear wall (2), a second portion of the second lateral flap (7) folded with respect to the first folded portion, wherein the second folded portion of the second lateral flap (7) is configured to move the second folded portion away from the rear wall to define essentially a lateral wall of the second lateral flap (7) of the container element.

In a 90th aspect, a process for manufacturing the element according to any of the preceding aspect is provided.

In a 91st aspect according to the preceding aspect, the process comprises the following steps:

providing the rear wall (2) of sheet material, providing the first front flap (3) of sheet material, providing the second front flap (4) of sheet material, providing the safety device of sheet material, during which the first coupling portion (13) associated to the first front flap and the second coupling portion associated to the second front flap are formed, the step of providing the safety device (12) forming on at least one of said coupling portions (13, 14) a removable portion (15) configured for separating from the safety device (12) upon a first open condition of the first and second front flaps after a first closed condition of these latter flaps.

In a 92nd aspect according to the preceding aspect, the first and the second front flap (3, 4) are joined in a single piece with the rear wall, wherein the step of providing the rear wall, the first front flap and the second front flap comprises:

a step of providing a single first sheet, for example made of paper material, according to a planar configuration, a step of notching said first sheet.

In a 93rd aspect according to the 91st or 92nd aspect, the first coupling portion (13) is directly joined in a single piece with the first front flap, wherein the step of providing the first coupling portion comprises the following steps:

providing a second sheet, for example made of paper material, according to a planar configuration, a step of notching said second sheet.

In a 94th aspect according to any of the aspects from the 91st to the 93rd, the first coupling portion (14) is directly joined in a single piece with the second front flap, wherein the step of providing the second coupling portion comprises the following steps:

providing a third sheet, for example made of paper material, according to a planar configuration, a step of notching said third sheet.

In a 95th aspect according to the preceding aspect, the first, second and third sheet are joined in a single piece to define a single sheet, the process comprises a single step of cutting said single sheet for defining the rear wall, the first front flap, the second front flap, the first coupling portion, the second coupling portion.

In a 96th aspect according to any of the aspects from the 91st to the 95th, the process further comprises the steps of providing the first and the second lateral flap, said step of providing said lateral flaps comprising the steps of:

providing a fourth and a fifth sheet, for example made of paper material, according to a planar configuration, notching said fourth and fifth sheet to define respectively the first and second lateral flap.

In a 97th aspect according to the preceding aspect, the first, second, third, fourth and fifth sheet are joined in a single piece to define a single sheet, the process comprises a single step of cutting the single sheet for defining said element (optionally said envelope element or container element or band element).

In a 98th aspect according to any of the preceding aspects, wherein the term envelope element means an envelope (1).

In a 99th aspect according to any of the preceding aspects, the term band element means a band (100).

In a 100th aspect according to any of the preceding aspects, the term container element means a container.

In a 101st aspect, the element is used according to any of the preceding aspects for containing and/or winding one or more products, said use comprising at least the following steps:

arranging at least said first and second front flap in the open condition, providing one or more products at, in particular above, the rear wall (2), defining the first closed condition of the first and second front flap so as to define the engagement of the first and second coupling portion of the safety device (12).

In a $102^{nd}$ aspect according to the preceding aspect, wherein the use further comprises the following steps:

following the positioning of at least one product on the rear wall (2), positioning the first and the second lateral flap (6, 7) above said at least one product, following the positioning of the first and second lateral flap (6, 7) above the at least one product, defining the first closed condition of the first and second front flap so as to define the engagement of the first and second coupling portion of the safety device (12), following the first closed condition of the first and second front flap, the first and the second lateral flap (6, 7) are interposed between the at least one product and the first and second front flap (3, 4).

In a $103^{rd}$ aspect according to the $101^{st}$ or $102^{nd}$ aspect, the use comprises containing one or more products comprising at least one selected in the group of: letters, documents made of sheet material, for example paper.

DESCRIPTION OF THE DRAWINGS

Some embodiments and some aspects of the invention will be described below with reference to the accompanying drawings, provided for indicative purposes only and therefore not limiting, wherein.

Figure 1:
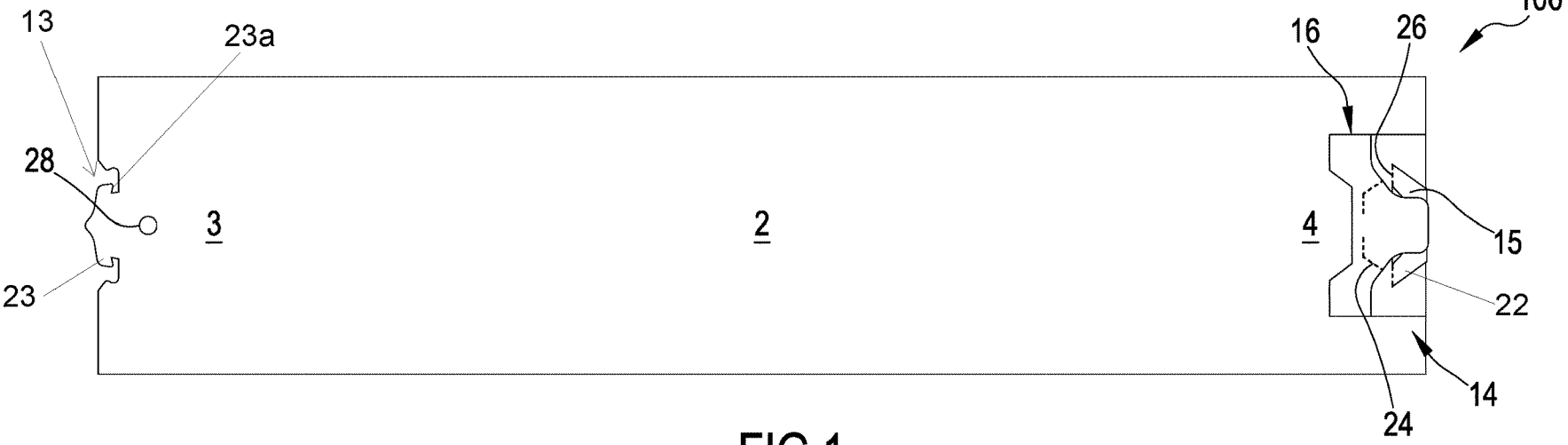
FIG. 1 is a top view of a band in accordance with a first embodiment.

FIGS. from 10 to 13 are schematic views of the envelope according to the present invention respectively illustrated in different operative conditions.

DEFINITIONS AND CONVENTIONS

It should be noted that in the present detailed description, corresponding parts illustrated in the various figures are indicated with the same numerical references. The figures may illustrate the object of the invention through representations not in scale; therefore, parts and components illustrated in the figures relating to the object of the invention may pertain exclusively to schematic representation.

The term "product" instead means an item or a set of items of any nature. The term "product" can also mean packaging, for example bearing a plurality of items.

The term "paper material" means paper or cardboard, optionally having at least 50% by weight, preferably at least 70% by weight, of organic material comprising one or more of cellulose, hemicellulose, lignin, derivatives of lignin. The paper sheet material usable for manufacturing the envelope (optionally the band or the container) can have grammage between 50 and 500 g/m$^2$, in particular between 200 and 400 g/m$^2$. The paper material in question extends between a first and a second prevalent development surface. The sheet paper material used for manufacturing the envelope (optionally of the band or of the container) can, in an embodiment variant, be covered for at least a part of the first and/or second prevalent development surface by a coating made of plastic material, for example a film, whose purpose is to reinforce the paper material. The coating can also be used to define a sort of barrier to water and/or humidity useful to avoid the weakening and the loss of structure of the envelope (optionally of the band or of the container) with consequent uncontrolled deformation of the paper material constituting the latter component.

The coating can be applied to the paper material in the form of a coating or varnish deposited from solution or sprayed, whose thickness is generally, without limitation, between 0.2 and 10 μm. Alternatively, the coating may comprise a plastic film, for example poly-coating, applicable by a lamination process, on one or both sides of the paper material. If the coating is applied by lamination, the values of the plastic film (coating) can for example vary between 4 and 400 μm, in particular between 10 and 200 μm, still more in particular between 10 and 100 μm, of coating material (i.e. of polythene). The plastic coating material can be selected, by way of example, between the following materials: PP, PE (HDPE, LDPE, MDPE, LLDPE), EVA, polyesters (including PET and PETg), PVdC. The envelope (optionally the band or the container) may be made of at least partly plastic sheet material or, alternatively, at least partly made of plastic material and partly of paper material.

The term "envelope element" means an envelope. The term "band element" means a band. The term "container element" means a container.

DETAILED DESCRIPTION

Tamper-Evident Envelope 1

The numeral 1 designates in its entirety a tamper-evident envelope for containing one or more products of various kinds. As is shown for example in FIGS. 9-11, the envelope 1 comprises a rear wall 2 made of sheet material, in particular of paper sheet material, extending in thickness between a first and a second surface and peripherally delimited by an edge (perimetral edge 5). The rear wall 2 is essentially a planar element: the wall 2 extends substantially along a prevalent development plane.

The rear wall 2 can have a rectangular shape; in this configuration, the perimetral edge 5 is defined by a first and a second longitudinal edge 2*a*, 2*b* distanced from and parallel to each other which are connected to a first and second transverse edge 2*c*, 2*d* (see FIG. 9): said first and second transverse edge are also spaced and parallel to each other. An envelope 1 may be manufactured having a rear wall 2 presenting a different shape, for example square, rhomboidal, circular, semi-circular, elliptical, triangular.

The rear wall 2 has a pre-set length L1 defined by the distance between the first and the second transverse edge 2*c*, 2*d*; the rear wall has a pre-set width L2 defined by the distance between the first and the second longitudinal edge 2*c*, 2*d*.

In the illustrated configuration, the length of the rear wall 2 is defined by the extension of the first and second longitudinal edge while the width of said wall 2 is defined by the extension of the first and second transverse edge.

As shown in the accompanying figures, the envelope 1 further comprises at least one front flap 3, also made of sheet material, for example, paper, engaged to the rear wall 2 at the perimetral edge 5. The first front flap 3 is directly connected to the perimetral edge 5 and extends in prolongation of the rear wall 2. The first front flap 3 is connected to the first transverse edge 2*c* of the rear wall 2 and joined in a single piece directly to the rear wall 2. In greater detail, the first front flap 3 extends from the rear wall 2 starting from the perimetral edge 5 of the latter wall 2 to a top portion 3*a* of the first front flap 3 distanced from said perimetral edge 5.

The first front flap 3 can have a rectangular shape (FIG. 9) wherein a side of said first edge 3 coincides with the first transverse edge 2*c* of the rear wall 2. The first flap 3 also extends in thickness between a first and a second surface; the first surface of the first front flap 3 extends seamlessly with respect to the first surface of the rear wall 2 while the second surface of said first flap 3 extends seamlessly with respect to the second surface of the rear wall 2.

Figure 11:
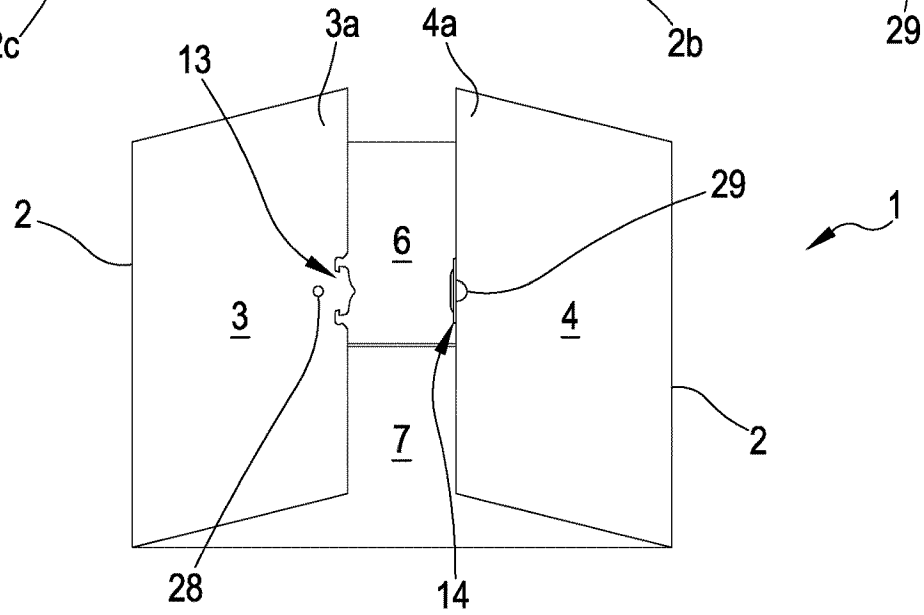
Figure 12:
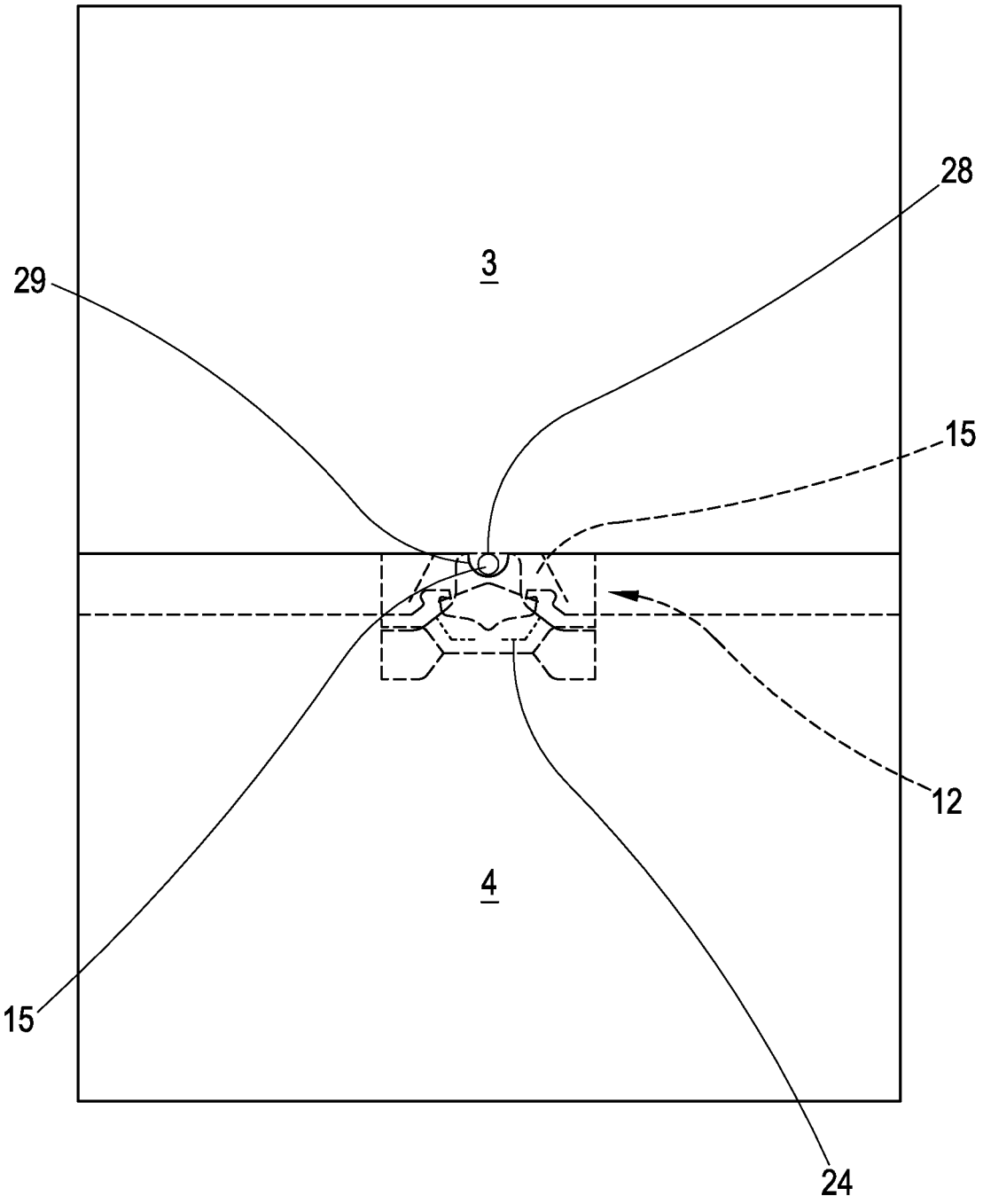

The first front flap 3 can be rotatively movable with respect to the rear wall 2 around the edge 5 (FIG. 11), in particular around the first transverse edge 2*c*. The front flap 3 is movable at least between a deployed position (FIG. 9) wherein the first flap lies essentially in the same prevalent development plane of the wall 2 (the flap 3 and the wall 2 are aligned along a same plane of lay) and a folded position wherein the first front flap 3 faces the rear wall 2 (FIGS. 11 and 12). In the folded position the first surface of the first front flap 3 faces, and optionally is at least partly in contact with, the first surface of the rear wall 2: the first flap can be folded on the rear wall 2 around a crease represented by the first transverse edge 2*c*. As specified above, the rear wall 2 extends along a prevalent development plan: the first front flap 3 is rotatively movable with respect to the rear wall 2 around an axis lying in the prevalent development plane of the rear wall 2. The first front flap 3 also extends along a respective prevalent development plan: the first front flap 3 is rotatively movable with respect to the rear wall 2 around an axis lying in the prevalent development plane respectively of the rear wall 2 and of the first front flap 3.

The first front flap 3 comprises at least one through opening 28 (FIG. 12) positioned at the top portion 3*a* of said first front flap 3. The opening 28 can be distanced from a perimetral edge of the first front flap 3 and be delimited by a closed perimetral edge; the opening 28 can have a circular shape (FIG. 9); alternatively, the opening 28 can have a different shape, for example rectangular, elliptic or square. The opening 28 can, however, be defined by an opened perimetral edge defining at least part of the perimetral edge of the first front flap 3; the opening 28 defines a through cavity for example having a substantially "V" or "C" or "U" shape.

The first front flap 3 has width coinciding with the width of the rear wall 2, in particular it coincides with the extension of the first transverse edge 2*c*. The first front flap 3 has a length, measured orthogonally to the first transverse edge 2*c*, that is smaller than the length of the rear wall. Preferably, the ratio between the length of the first flap 3 and the length L1 of the rear part 2 is between 0.2 and 0.8, in particular between 0.4 and 0.6.

The envelope comprises a second front flap 4 of sheet material, for example of paper sheet material, also engaged to the rear wall 2 at the perimetral edge thereof and opposite to said first front flap 3. In particular, the second front flap 4 is directly connected to the perimetral edge 5 and extends in prolongation of the rear wall 2. The second front flap 4 is connected to the second transverse edge 2*d* of the rear wall 2 and it is joined in a single piece directly to the rear wall 2. In greater detail, the second front flap 4 extends from the rear wall 2 starting from the perimetral edge 5 of the latter wall 2 to a top portion 4*a* of the second front flap 4 distanced from said perimetral edge 5. The second flap 4 can have a rectangular shape (FIG. 9) wherein a side of said second front edge 4 coincides with the second transverse edge 2*d* of the rear wall 2. A second front flap 4 may be obtained, having a different shape, for example square, triangular, semi-circular. The second flap 4 also extends in thickness between a first and a second surface; the first surface of the second front flap 4 extends seamlessly with respect to the first surface of the rear wall 2 while the second surface of said second flap 4 extends seamlessly with respect to the second surface of the rear wall 2.

The second front flap 4 can be rotatively movable with respect to the rear wall 2 around the edge 5, in particular around the first transverse edge 2*d*. The front flap 4 is movable at least between a deployed position (FIG. 9) wherein the second flap lies essentially in the same prevalent development plane of the wall 2 (the flap 4 and the wall 2 are aligned along a same plane of lay) and a folded position wherein the second front flap 4 faces the rear wall 2 (FIGS. 11 and 12). In the folded position the first surface of the second front flap 4 faces, and optionally is at least partly in contact with, the first surface of the rear wall 2. In other words, the second flap 4 made of sheet material is foldable on the rear wall 2 around a creasing represented by the second transverse edge 2*d*.

The rear wall 2 extends along a prevalent development plan: the second front flap 4 is rotatively movable with respect to the rear wall 2 around an axis lying in the prevalent development plane of the rear wall 2. The second front flap 4 also extends along a respective prevalent development plan: the second front flap 4 is rotatively movable with respect to the rear wall 2 around an axis lying in the prevalent development plane respectively of the rear wall 2 and of the second front flap 4.

The first and the second flap 3, 4 can both be rotatively movable (foldable) with respect to the rear wall. However, an envelope 1 may be manufactured in which one between said first and second front flap 3, 4 is rotatively movable with respect to the rear wall 2 while the other one between said second and first front flap 4, 3 is constrained to the rear wall; in this configuration, the fixed flap will be stably facing the rear wall 2.

The second front flap 4 has width coinciding with the width of the rear wall 2, in particular it coincides with the extension of the second transverse edge 2*d*. The second front flap 4 has a length, measured orthogonally to the second transverse edge 2*d*, that is smaller than the length L1 of the rear wall. Preferably, the ratio between the length of the second flap 4 and the length L1 of the rear part 2 is between 0.2 and 0.8, in particular between 0.4 and 0.6. Advantageously, the sum of the length of the first and second front flap is greater than the total length L1 of the rear wall 2.

The second front flap 4 can comprise at the top portion 4*a* of said front flap 4 an cavity 29 which can be in contact with a perimetral edge of said second front flap 4 to define thereon a sort of drop (drop approaching the second transverse edge 2*d* of the rear wall 2) having a maximum depth greater than 1 mm, in particular between 2 and 10 mm. The cavity 29 can have an open perimetral profile having substantially "C" or "V" or "U" shape.

Figure 9:
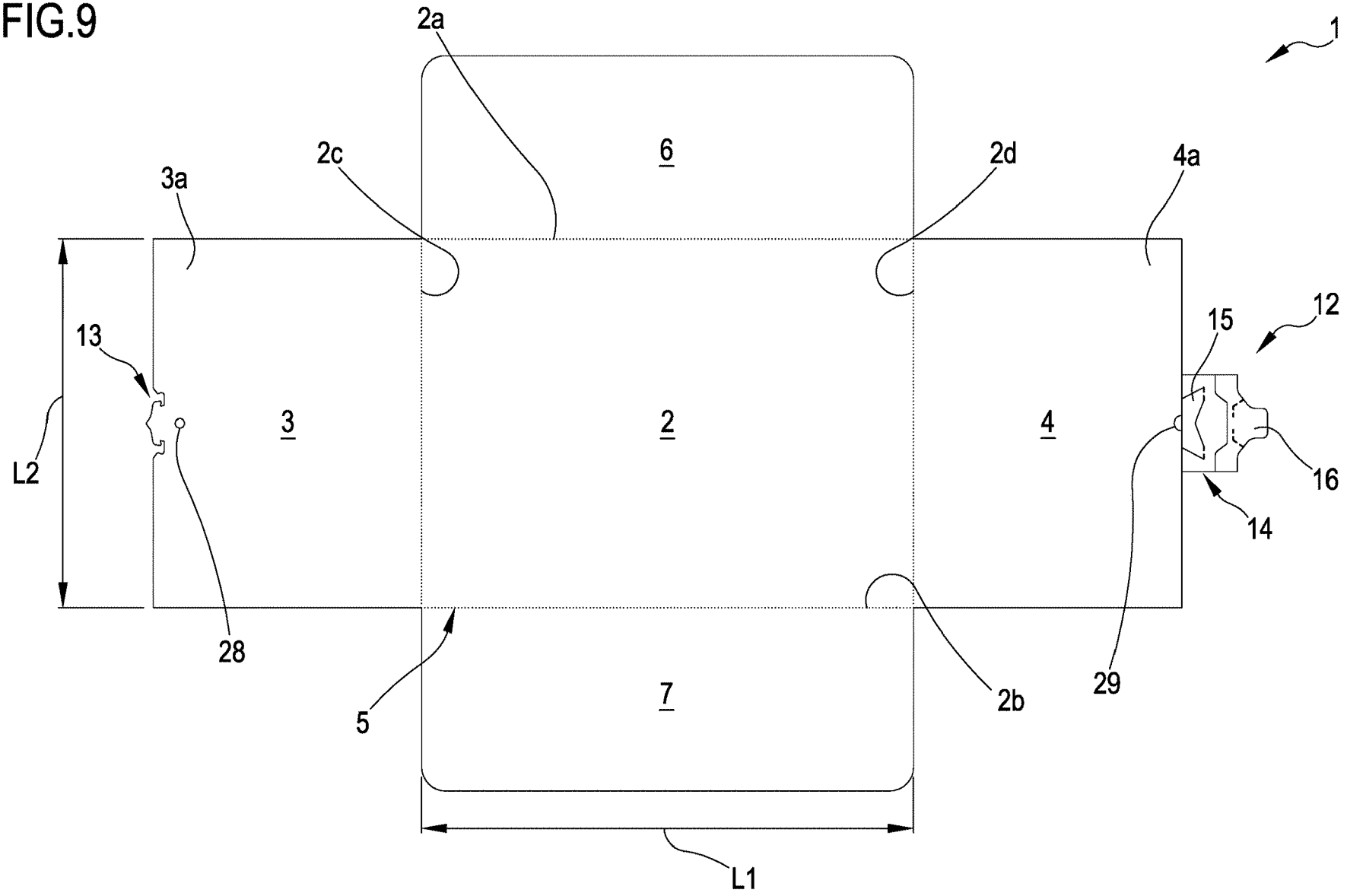
FIG. 9 is a top view of an envelope according to the present invention.
Figure 10:
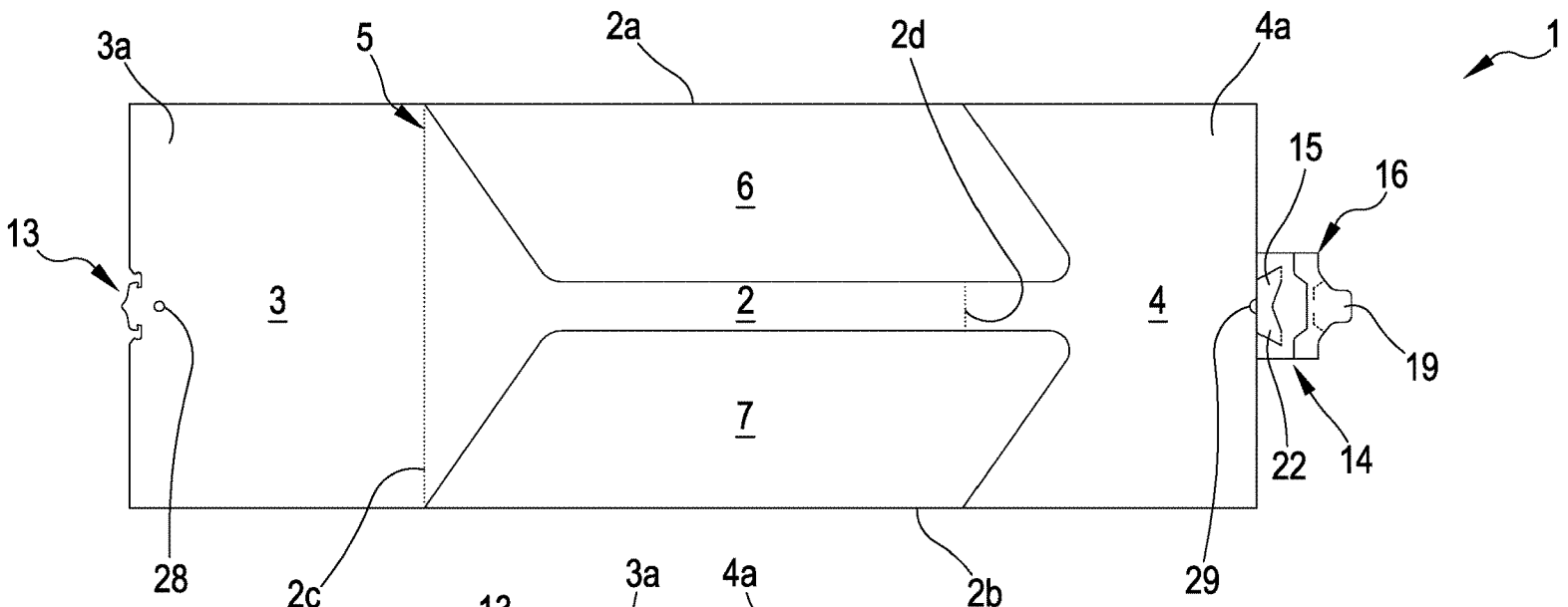

The first and the second front flap 3, 4 are configured for defining at least one closed condition wherein these latter substantially face the rear wall 2 and are at least partially in contact with and overlapped each other (FIG. 12); the first and second front flap 3, 4 are further configured for defining at least one open condition, wherein these latter are distanced from each other (see for example FIG. 9). FIG. 11 shows a schematic view of the passage of the first and second flap from the open condition to the closed condition. At least one between said first and second front flap 3, 4 is then rotatively movable with respect to the rear wall 2 at least between:

the closed condition wherein the at least one between said first and second front flaps 3, 4 substantially faces the rear wall 2, the open condition wherein the at least one between said first and second front flaps 3, 4 is distanced from the other between said second and first front flap.

The first and the second front flap 3, 4—in the closed condition—both face the first surface of the rear wall 2. In the closed condition, the first surface of the rear wall 2—together with the first surface of the first and second front flap 3, 4—define an inner surface of the envelope 1 while the second surface of the wall 2—together with the second surfaces of the first and second front flap 3, 4—define an outer surface of the envelope 1. In greater detail, the first surfaces of the first and second front flap 3, 4—in the closed condition thereof—at least partly face the first surface of the rear wall 2.

The envelope 1 can comprise a first lateral flap 6 engaged with the rear wall 2 at the perimetral edge 5 thereof adjacently the first and the second front flap 3, 4. In particular, the first lateral flap 6 is directly connected to the perimetral edge 5 and extends in prolongation of the rear wall 2. The first lateral flap 6 is connected and joined in a single piece to the first longitudinal edge 2*a* of the rear wall 2. In greater detail, the first lateral flap 6 extends from the rear wall 2 starting from the perimetral edge 5 of the latter wall 2 to a top portion 3*a* of the first lateral flap 6 distanced from said perimetral edge 5.

The first lateral flap 6 can have a rectangular shape (FIG. 9) wherein a side of said first lateral edge 6 coincides with the first longitudinal edge 2*a* of the rear wall 2. A first lateral flap 6 may be obtained, having a different shape, for example square, triangular, semi-circular. The first lateral flap 6 also extends in thickness between a first and a second surface; the first surface of the first lateral flap 6 extends seamlessly with respect to the first surface of the rear wall 2 while the second surface of said first flap 6 extends seamlessly with respect to the second surface of the rear wall 2. The first flap 6, in the closed condition of the first and second flap, is interposed between said flaps 3, 4 and said rear wall 2; in other words, the first and the second front flap 3, 4—in the closed condition they are positioned above (overlapped) said first lateral flap 6. The first lateral flap 6 can be rotatively movable with respect to the rear wall 2 around the edge 5, in particular around the first longitudinal edge 2*a*. The lateral flap 6 is movable at least between a deployed position (FIG. 9) wherein the first flap lies essentially in the same prevalent development plane of the wall 2 (the flap 6 and the wall 2 are aligned along a same plane of lay) and a folded position wherein the first lateral flap 6 faces the rear wall 2 (FIGS. 11 and 12). In particular, in the folded position the first surface of the first lateral flap 6 faces, and optionally is at least partly in contact with, the first surface of the rear wall 2.

As specified above, the rear wall 2 extends along a prevalent development plan: the first lateral flap 6 is rotatively movable with respect to the rear wall 2 around an axis lying in the prevalent development plane of the rear wall 2. As shown in the accompanying figures, the first lateral flap 6 also extends along a respective prevalent development plan: the first front flap 6 is rotatively movable with respect to the rear wall 2 around an axis lying in the prevalent development plane respectively of the rear wall 2 and of the first lateral flap 6. If the first lateral flap 6 is movable with respect to the rear wall 2, during the closed condition of the first and second front flap 3, 4—an initial bending of the first lateral flap 6 is provided above the rear wall 2 and a subsequent bending of the first and second front flap above said lateral flap 6.

The first lateral flap 6 has width coinciding with the length of the rear wall 2, in particular it coincides with the extension of the first longitudinal edge 2*a*. The first lateral flap 6 has a length, measured orthogonally to the first longitudinal edge 2*a*, that is smaller than the width L2 of the rear wall 2. For example, the ratio between the length of the first flap 6 and the width L2 of the rear part 2 is between 0.2 and 0.8, in particular between 0.4 and 0.6.

The envelope 1 can also comprise a second lateral flap 7 engaged with the rear wall 2 at the perimetral edge 5 thereof adjacently the first and the second front flap 3, 4: the second lateral flap 7 is opposite to the first lateral flap 6. In particular, the second lateral flap 7 is directly connected to the perimetral edge 5 and extends in prolongation of the rear wall 2. The second lateral flap 7 is connected and joined in a single piece to the second longitudinal edge 2*b* of the rear wall 2. In greater detail, the second lateral flap 7 extends from the rear wall 2 starting from the perimetral edge 5 of the latter wall 2 to a top portion 3*a* of the second lateral flap 7 distanced from said perimetral edge 5. The second lateral flap 7 can have a rectangular shape (FIG. 9) wherein a side of said second lateral edge 7 coincides with the second longitudinal edge 2*b* of the rear wall 2. A second lateral flap 7 may be obtained, having a different shape, for example square, triangular, semi-circular. The second lateral flap 7 also extends in thickness between a first and a second surface; the first surface of the second lateral flap 7 extends seamlessly with respect to the first surface of the rear wall 2 while the second surface of said second flap 7 extends seamlessly with respect to the second surface of the rear wall 2.

The second flap 7, in the closed condition of the first and second front flap, is interposed between said flaps 3, 4 and said rear wall 2: the first and the second front flap 3, 4—in the closed condition they are positioned above (overlapped) said first lateral flap 6. Both the first and the second lateral flap 6, 7 are configured to be arranged—in the closed condition of the first and second front flap 3, 4—interposed between the rear wall 2 and said first and second front flap 3, 4.

The second lateral flap 7 can be rotatively movable with respect to the rear wall 2 around the edge 5 (FIG. 10), in particular around the second longitudinal edge 2*b*. The lateral flap 7 is movable at least between a deployed position (FIG. 9) wherein the second flap lies essentially in the same prevalent development plane of the wall 2 (the flap 7 and the wall 2 are aligned along a same plane of lay) and a folded position wherein the second lateral flap 7 faces the rear wall 2 (FIGS. 11 and 12). In particular, in the folded position the first surface of the second lateral flap 7 faces, and optionally is at least partly in contact with, the first surface of the rear wall 2. In yet other words, the second flap 6 is foldable on the rear wall 2 around a creasing represented by the second longitudinal edge 2*b*.

As specified above, the rear wall 2 extends along a prevalent development plan: the second lateral flap 7 is rotatively movable with respect to the rear wall 2 around an axis lying in the prevalent development plane of the rear wall 2. The second lateral flap 7 also extends along a respective prevalent development plan: the second front flap 7 is rotatively movable with respect to the rear wall 2 around an axis lying in the prevalent development plane respectively of the rear wall 2 and of the second lateral flap 7. If the second lateral flap 7 is movable with respect to the rear wall 2, during the closed condition of the second and second front flap 3, 4—an initial bending of the second lateral flap 7 is provided above the rear wall 2 and a subsequent bending of the first and second front flap above said lateral flap 7.

The second lateral flap 7 has width coinciding with the length of the rear wall 2, in particular it coincides with the extension of the second longitudinal edge 2*b*. The second lateral flap 7 has a length, measured orthogonally to the second longitudinal edge 2*b*, that is smaller than the width L2 of the rear wall 2. For example, the ratio between the length of the second flap 7 and the width L2 of the rear part 2 is between 0.2 and 0.8, in particular between 0.4 and 0.6.

The first and the second lateral flaps 6, 7 can both be rotatively movable (foldable) with respect to the rear wall and—at least in the closed condition of the first and second front flap 3, 4—they extend in prolongation starting from the rear wall 2 towards each other. The first and the second lateral flaps 6, 7 have such a pre-set length as to allow—in the closed condition of the first and second front flap during which also the first and the second lateral flap face the rear wall—covering a preponderant part of the rear wall. In greater detail, the ratio between the sum of the lengths of the first and second lateral flap 6, 7 and the width of the rear part 2 is between 0.3 and 1.5, in particular between 0.5 and 1.3, still more in particular between 0.8 and 1.2.

The envelope 1 comprises a safety device 12 made of sheet material, in particular entirely of paper sheet material, comprising a first coupling portion 13 borne by the first front flap 3 and a second coupling portion 14 borne by the second front flap 4. The first and second coupling portions 13, 14 are configured for stably engaging with each other during a first closed condition of the first and second front flaps 3, 4. At least one between the first and the second coupling portion 13, 14 has at least one removable portion 15 configured to separate from the safety device 12 upon a first open condition of the first and second flap 3, 4—following said first closed condition—to prevent a subsequent coupling of said first and second coupling portion 13, 14 and for revealing tampering with the envelope 1.

Figure 4:
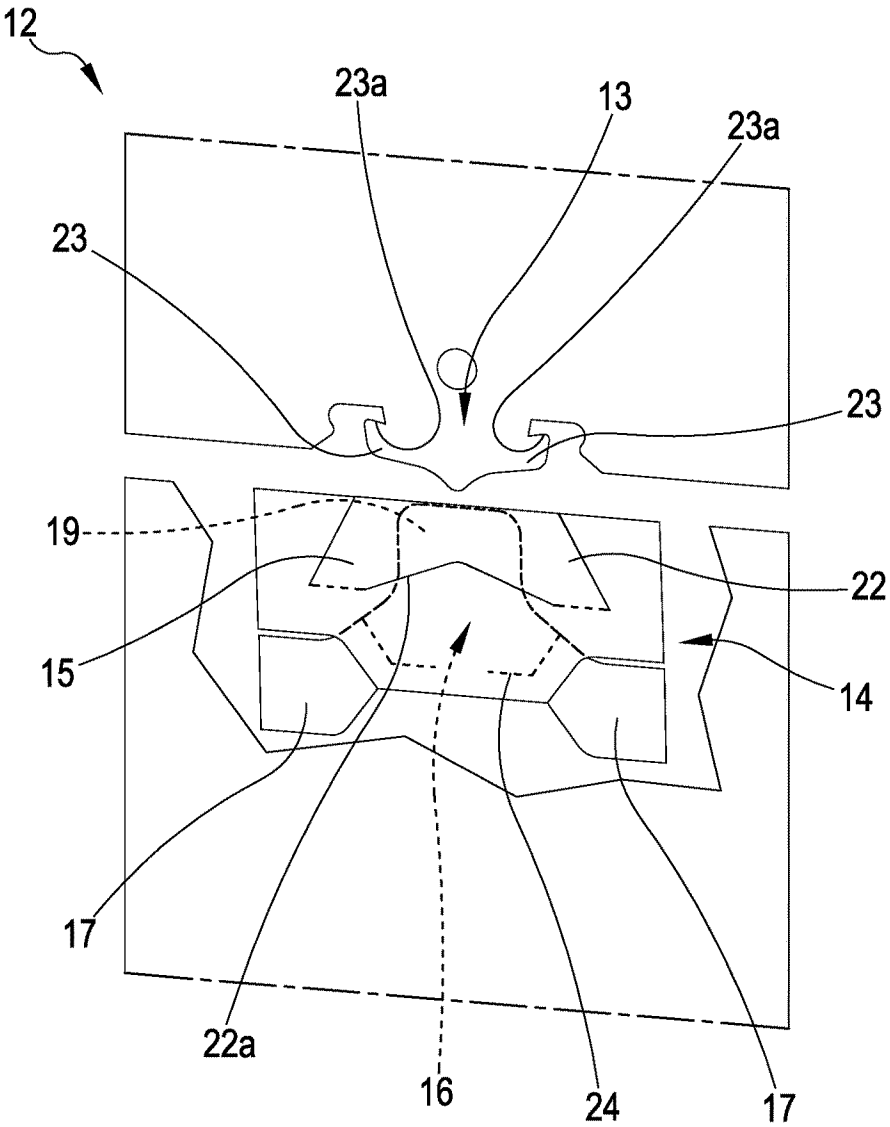

The first coupling portion 13 is borne by the first front flap 3 and positioned at the top portion 3*a*. In detail, the first coupling portion 13 and the first flap 3 are joined in a single piece to form a single body. The first coupling portion 13 is made of sheet material, in particular of paper material, and extends in prolongation, seamless, from the first front flap 3: said first coupling portion 13 essentially defines a part of an outer delimitation perimeter of the first front flap 3 opposite to the first transverse edge 2*c*. In other words, the first front flap 3 is essentially interposed between the rear wall 2 and the first coupling portion 13. The first coupling portion 13 extends between a first and a second surface respectively oriented in the same direction as the first and second surface of the first front flap 3 and of the rear wall 2. The first surfaces respectively of the first coupling portion 13 and of the first front flap 3 are seamless. Equally, the second surfaces respectively of the first coupling portion 13 and of the first front flap 3 are seamless. In the closed condition of the first and second flap, the first surface of the first coupling portion 13 (like the first surface of the first flap 3) is oriented towards the first surface of the rear wall 2. In greater detail, the first coupling portion 13 comprises at least one hook 23 defining at least one undercut portion delimited by a gripping edge 23*a*: the hook 23, in the first closed condition of the first and second flap, is configured to engage with the second coupling portion 14. As shown for example in FIG. 4, the hook 23 defines a seat having substantially "C" shape. The first coupling portion 13 can, however, comprise two mutually opposite hooks 23. In this condition, the first portion 13 then comprises two respective undercuts which, at least in the first closed condition of the first and second front flap 3, 4, are configured to both engage with the second coupling portion 14. The two undercuts comprise respective seats whose concavity is oriented at the opposite site with respect to each other. The presence of two undercuts substantially defines a double symmetrical grip on the second coupling portion 14 which makes more effective and stable the coupling between said first and second coupling portion 13, 14.

Figure 3:
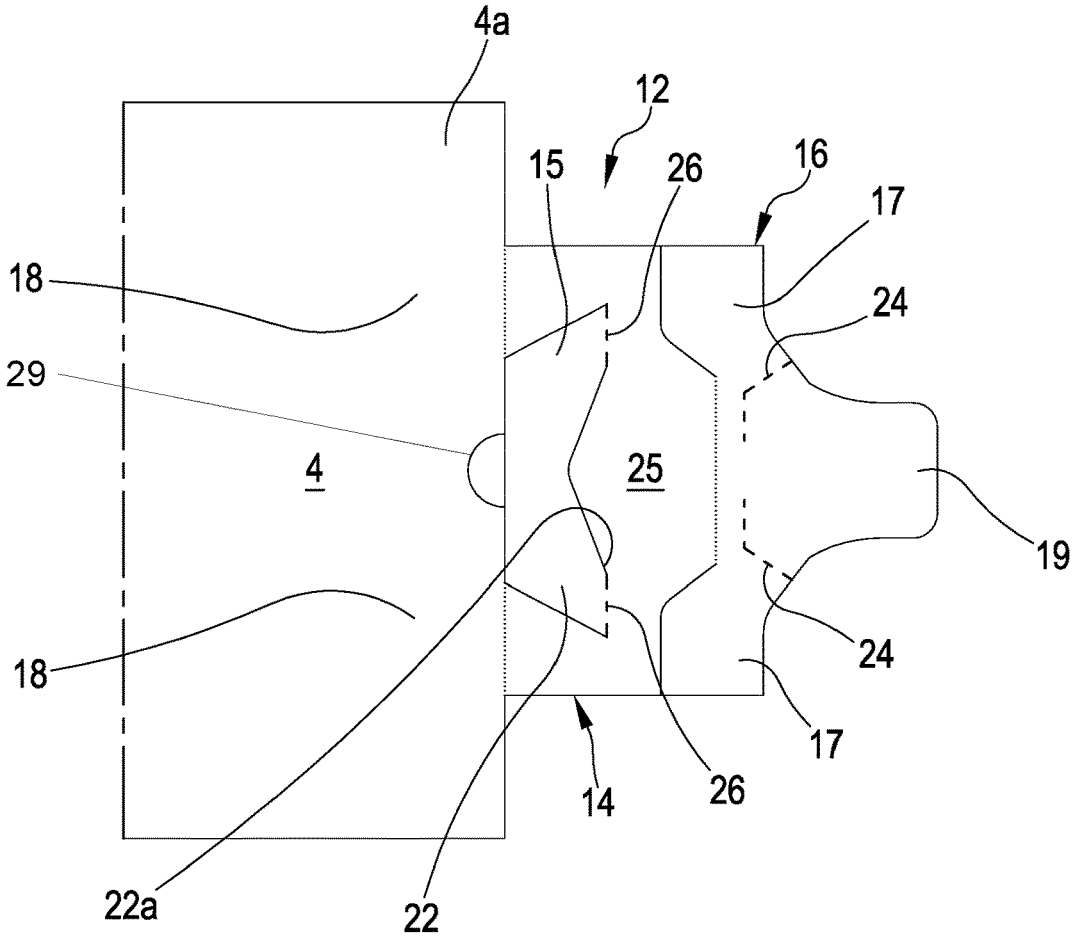
FIGS. 3 and 3A are respective detailed view of a portion of a safety device according to the present invention.

The second coupling portion 14, also made of sheet material (optionally, of paper material), is borne by the second front flap 4 and positioned at the top portion 4*a*. The second coupling portion 14 faces and is at least partially in contact with the second front flap 4 (FIGS. 3A and 4): the second coupling portion 14 overlaps the second front flap 4. FIG. 3 is an exemplifying figure of the second coupling portion in extended (non-operating) condition: FIG. 3 was introduced the better to show a non-limiting structure of the second coupling portion 14.

The second coupling portion 14 is at least partly engaged to the first surface of the second front flap 4 at the top portion thereof. The second coupling portion 14 can be glued to the first surface of the second front flap 4. The second coupling portion 14 also extends between a first and a second surface. The first surface of the second coupling portion 14 faces and is at least partly in contact with the first surface of the second front flap 4. In the closed condition of the first and second flap, the second surface of the second coupling portion 14 is instead oriented towards the first surface of the rear wall 2.

Figure 3A:
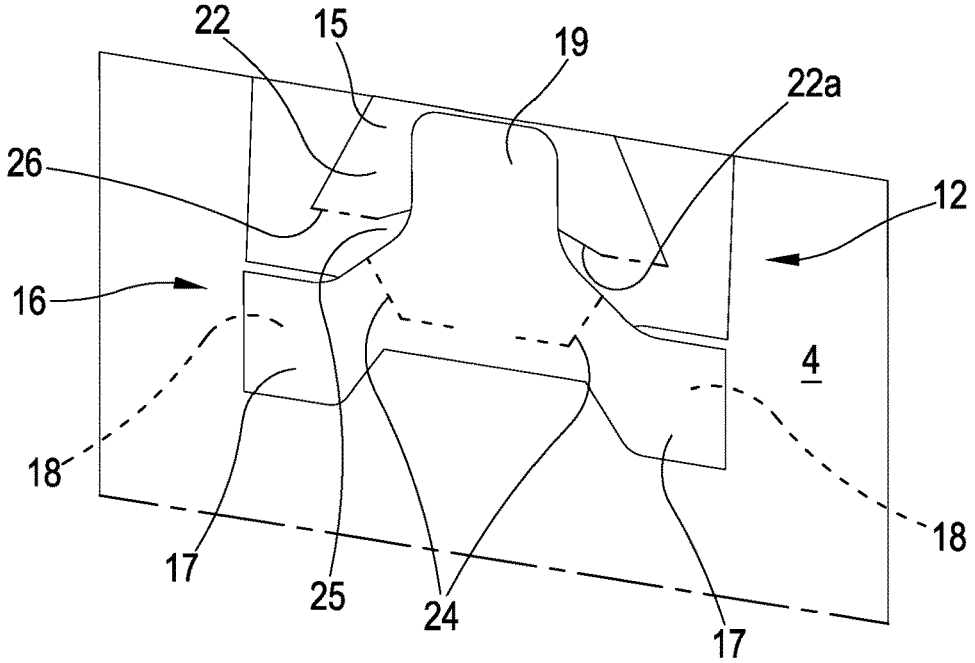

In greater detail, the second coupling portion 14 and the second flap 4 are joined in a single piece to form a single body (a single sheet). The first surfaces respectively of the second coupling portion 14 and of the second front flap 4 are seamless. Equally, the second surfaces respectively of the second coupling portion 14 and of the second front flap 4 are seamless. In fact, the second coupling portion 14 comprises a sheet joined in a single piece to the second front flap 4 which is folded on the latter flap 4. FIG. 3 shows the second coupling portion joined in a single piece to the second flap 4 while FIG. 3A shows the second coupling portion folded on said second front flap 4. The second coupling portion is joined in a single piece to a perimetral edge of the second flap positioned opposite to the second transverse edge 2*d* of the rear wall 2. In greater detail, the second coupling portion 14 comprises at least one hook 22 defining at least one undercut portion delimited by a gripping edge 22*a*: the hook 22, in the first closed condition of the first and second flap, is configured to engage with the first coupling portion 13 and in particular with the at least one hook 23 of said first coupling portion 13. The hook 22 defines a seat having substantially "C" shape. The hooks 22, 23 respectively of the first and second coupling portions 13, 14, are configured for stably engaging with each other at least during the first closed condition of the first and second front flaps, said hooks 22, 23—under the first closed condition of the first and second front flaps—exhibiting respective mutually facing concavities.

The second coupling portion 14 comprises a single hook 22 delimiting a single gripping edge 22*a* which is configured to receive in engagement one or more hooks 23 of the first coupling portion. In greater detail, the second coupling portion 14 comprising a base body 25 which directly bears the hook 22 of the same second coupling portion 14; the hook 22 is rotatively movable with respect to said base body 24: only the base body 25 of the second coupling portion 14 is directly constrained, for example by gluing, to the second front flap 4. The hook 22 is rotatively movable with respect to the base body to allow a correct coupling between the first and the second coupling portion 13, 14.

As described above, the first and the second coupling portions 13, 14 are respectively positioned at the top portions 3*a*, 4*a* of the first and second front flap 3, 4; in the first closed condition of the first and second front flaps 3, 4, the respective top portions 3*a*, 4*a* of said front flaps are configured for overlapping each other and enabling the engagement of the first and second coupling portions 13, 14. In fact, as a result of the length of the first and second flap, they are configured for overlapping each other at least for the top portion, so as to be assure the coupling between the first and the second coupling portion at least during the first closed condition of said flaps 3, 4.

As described above, the second coupling portion 14 faces the second front flap 4 (it does not extend in prolongation of the second flap, as instead takes place for the first coupling portion 13 with respect to the first flap 3); in this way, the gripping edge 22*a* of the hook 22 is distanced from an outer peripheral edge of the second flap 4: the gripping edge 22*a* remains essentially covered by the second front flap 4 so that—in the first closed condition of the first and second flap 3, 4—the first and the second coupling portion 13, 14 are distant and covered by the second flap 4. Said configuration does not allow access to the coupling portions 13, 14 during the first closed condition and prevents tampering with the safety device. In the first closed condition of the first and second flap, the gripping edge 22*a*, 23*a* respectively of the hooks 22 and 23 are distant from the outer perimetral edge of the second flap 4 which fully covers the coupling between first and second coupling portion 13, 14 (see FIG. 8). FIG. 3 shows the open condition of the first and second flap 3, 4; in this condition, the first and second coupling portions 13, 14 are mutually distanced.

Figure 5:
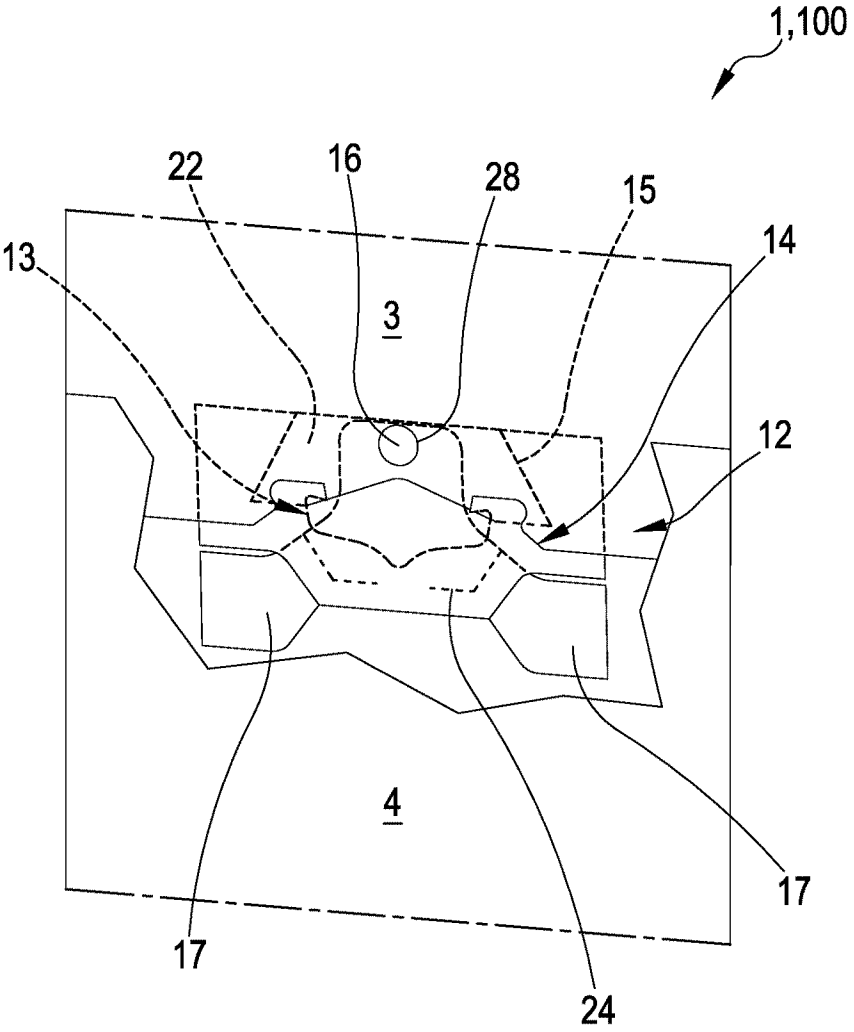
FIGS. 4 and 5 are schematic views of a safety device according to the present invention respectively according to different operative conditions.
Figure 8:
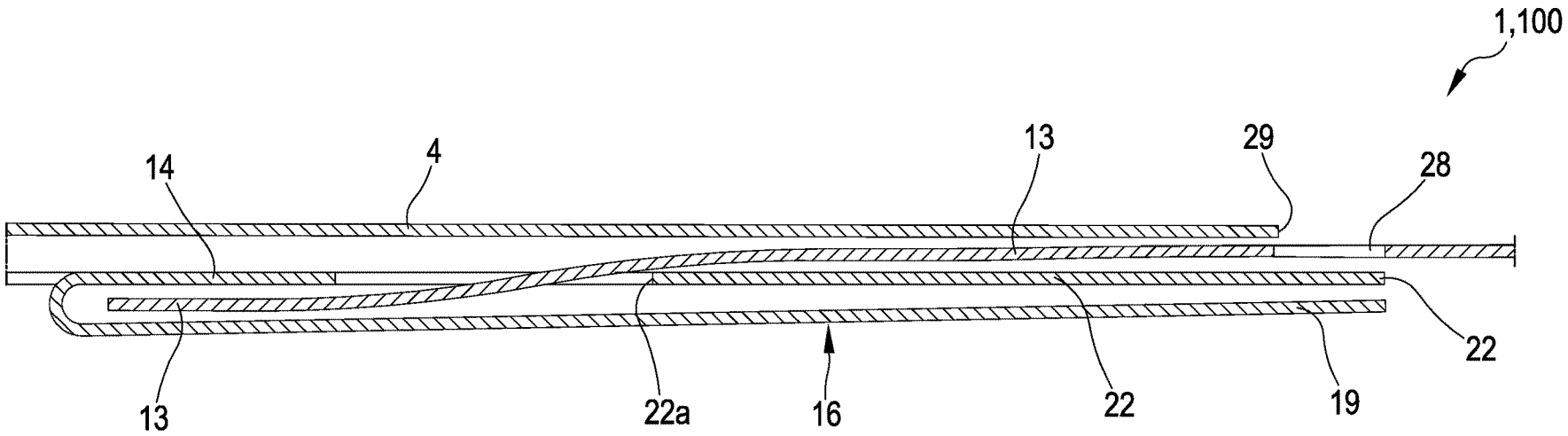
FIGS. 8 and 8A are section views of a safety device according to the present invention respectively during an armed condition (FIG. 8) and an insertion condition (FIG. 8A) of the safety device.
Figure 8A:
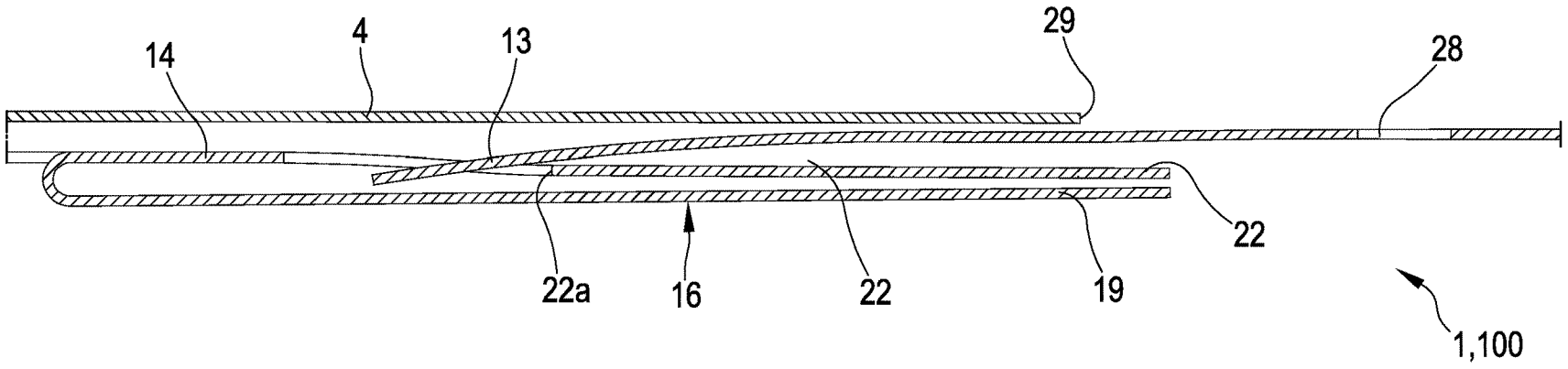

The section view of FIG. 8A shows the step in which the first and the second coupling portions execute the first closed condition. It can be seen that the first coupling portion 13 initially overlaps between the second flap 4 and the second coupling portion 14; the first coupling portion passes between the hook 22 and the base body 25 so that the hook 23 can be constrained (locked) to the hook 22 (condition shown in FIG. 8). In the armed condition shown schematically in FIGS. 5 and 8, the hook 22 of the second coupling portion 14 is engaged (settled) with at least one of the hooks 23 of the first coupling portion. The first closed condition of the first and second front flap 3, 4 allows to define an armed (activated) condition of the safety device 12.

The accompanying figures show a first closed condition of the first and second front flaps, in which the first coupling portion 13—when coupling with the second coupling portion 14—passes between the second flap 4 and the second coupling portion 14. In this condition, the first coupling portion 13 initially slides anteriorly to the hook 22 (the first coupling portion 13 is interposed between the hook 22 and the top portion 4*a* of the second flap 4) and then traverses the cavity defined by the hook 22: at the end of the step of arming the system (first closed condition), the second portion 14 is interposed between the second front flap 4 and the first coupling portion 13. It is possible to execute a first closed condition in which the first coupling portion—during the engagement—executes a rear passage (passage from the rear) to the second coupling portion so that the latter is—also in consideration of the step of inserting the first portion 13—between the latter portion 3 and the second flap 4 (condition not shown in the accompanying figures). In this condition, during the first closed condition, the first coupling portion 13 is configured to slide initially posteriorly to the hook 22 (the hook 22 is interposed between the first coupling portion 13 and the top portion 4*a* of the second flap 4) to then traverse the cavity defined by the hook 22 and be interposed between said second flap 4 and the second coupling portion 14.

Based on the insertion mode, the portion 13 can be interposed between the second flap 4 and the second coupling portion 14 or else the second coupling portion 14 can be interposed between the first coupling portion 13 and the second flap 4. Regardless of the passage of the first coupling portion 13, at the end of the coupling step and hence in the first closed condition, the hooks 22 and 23 are mutually engaged to define the arming of the safety device.

Figure 13:
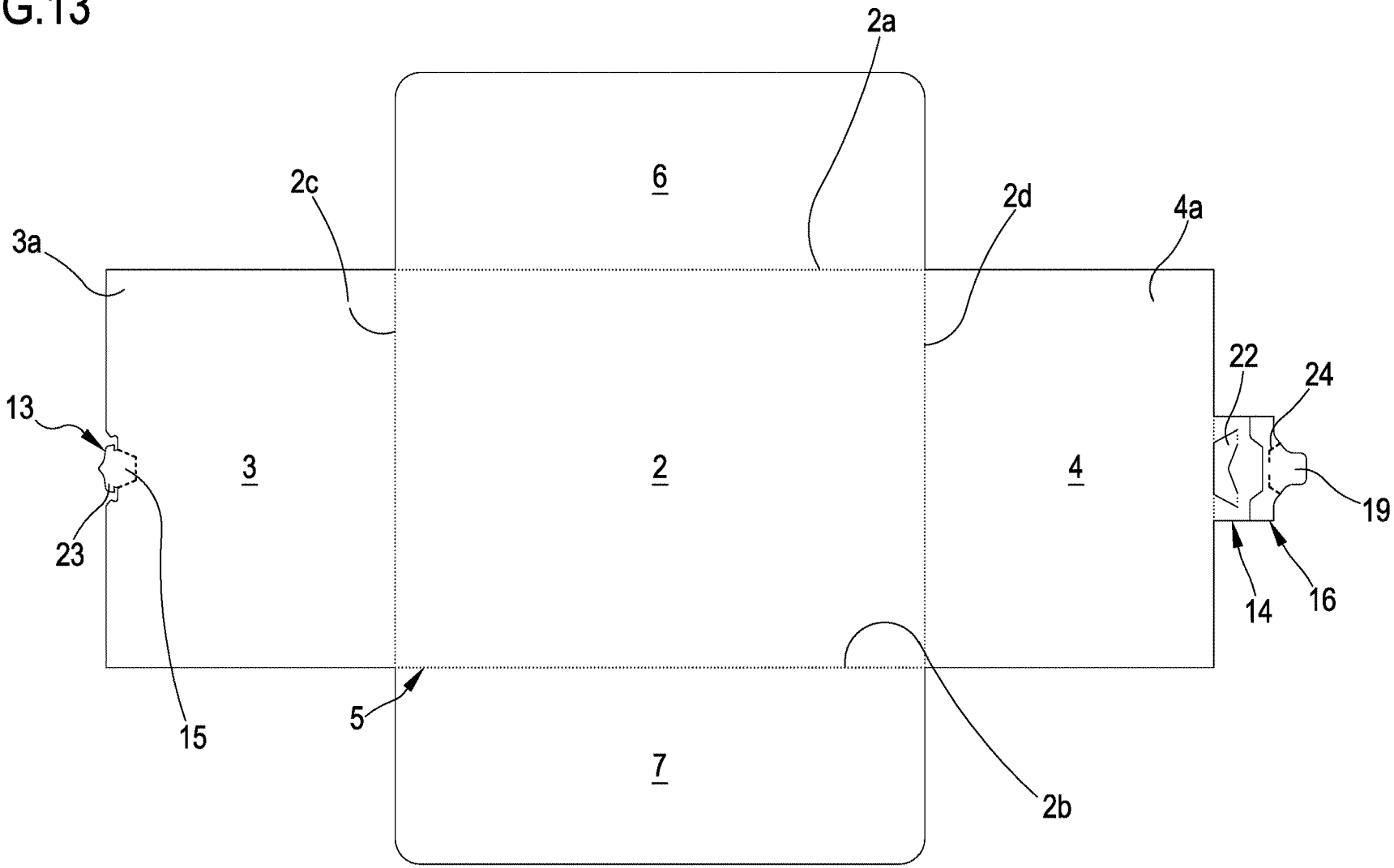

As described above, the safety device 12 comprises at least one removable portion 15 configured to separate from the safety device 12 following a first closed condition of the first and second flap 3, 4—after said first closed condition—to prevent a subsequent coupling of said first and second coupling portion 13, 14 and to reveal tampering with the envelope 1. The removable portion 15, defined on at least one between the first and the second coupling portion 13, 14 comprises at least one undercut defining essentially a coupling edge adapted to receive in engagement the other one between said second and/or first coupling portion 14, 13. FIGS. 9-12 show an envelope 1 in which the removable portion 15 is defined by at least part of the second coupling portion 14; in particular, the removable portion 15 is defined entirely by the hook 22 of the second coupling portion 14: the coupling edge of the removable portion 15 essentially coincides with the gripping edge 22*a* of the second coupling portion 14. In greater detail, the second coupling portion 14 comprises a weakening element 26 delimiting the hook 22 of the same second coupling portion 14 which defines said removable portion 15: the second coupling portion 14 has a weakening between a base body 25 and the hook 22 so that said hook 22 can define said removable portion 15. In this condition, during the first open condition of the envelope the hook 23 of the first portion 13 is configured to rip the removable portion 15 (the hook 22) off from the second coupling portion so as to reveal any tampering (first opening) of the envelope 1. Alternatively, the removable portion 15 is defined by at least a part of the first coupling portion 13 (FIG. 13); in particular, the removable portion 15 is defined entirely by the hook 23 (by the hooks 23) of the first coupling portion 13: in this configuration, the coupling edge of the removable portion 15 essentially coincides with the gripping edge 23*a* of the first coupling portion 13. In greater detail, the first coupling portion 13 comprises a weakening element 26 delimiting the hook 23 of the same first coupling portion 13 which defines said removable portion 15: the first coupling portion 13 has a weakening between the first front flap 3 and the hook 23 so that said hook 23 can define said removable portion 15. In this condition, during the first open condition of the envelope the hook 22 of the second portion 14 is configured to rip the removable portion 15 (the hook 23) off from the first coupling portion so as to reveal any tampering (first opening) of the envelope 1.

As specified above, the first and second coupling portion can be joined in a single piece respectively to the first and to the second front flap of the envelope; the weakening portion 26 of the first or second coupling portion 13, 14 can comprise at least one selected from: one or more cuts through the sheet material, a die-cut of the sheet material, a local compression of the sheet material.

The second front flap 4 can comprise a cavity 29 able to define substantially a drop of the outer perimetral edge of the second flap. The cavity 29 is configured—under the first closed condition of the first and second front flaps—for enabling to display the removable portion 15. Equally, the first front flap 3 comprises a through opening 28 defined configured—under the first closed condition of the first and second front flaps—for enabling to display the removable portion 15. In fact, the through opening 28, in the first closed condition of the first and second front flap, is positioned at the cavity 29: the cavity 29 and the through opening 28 face each other. The through opening 28 and the cavity 29 are at least partly counter-shaped with respect to each other and cooperate to allow—at least in the first closed condition of the first and second front flap—the display of the removable portion 15.

The safety device 12 is configured to reveal tampering with the envelope 1; in particular, the engagement of the removable portion 15 with the first or second coupling portion defines a stable engagement between the first and the second front flap that opposes the opening of the envelope 1. At the first opening, the user perceives a marked resistance to the opening of the envelope—provided that the envelope has not been opened the first time. The safety device 12, during the first opening condition, is configured to allow the detachment of the removable portion 15 from the second coupling portion 14. After the first opening condition, the device 12 is able to reveal tampering because the separation of the first and second flap is facilitated: the user does not perceive the correct resistance to the opening of the envelope that thus indicates tampering with (first opening of) the envelope. Moreover, after the first opening condition, at least the cavity 29, in particular the cavity 29 in cooperation with the through opening 28, allows to display the lack of the removable portion 15: in this condition, the user can easily notice tampering with the envelope 1 without actually opening it.

The accompanying figures show an envelope 1 comprising a support portion 16 of sheet material directly constrained to at least one between the second front flap 4 and second coupling portion 14. The support portion 16 is essentially side by side at least with the second coupling portion 14 so that at least part of said portion 14 is interposed between the second front flap 4 and said support portion 16. The support portion 16 is configured—at least during an initial contact step between the first and second coupling portions 13, 14 before said first closed condition of the first and second front flaps—for supporting at least part of said second coupling portion 14. In greater detail, the support portion 16 essentially comprises a tab, preferably but without limitation made of paper material, comprising at least a mutual coupling portion 17 overlapping and stably constrained to at least a respective mutual coupling portion 18 of at least one selected between the second front flap 4 and the second coupling portion 14. The mutual coupling portion 18 can be defined on the second front flap 4 (FIGS. 3 and 3A): the support portion is directly constrained, for example by gluing, to the first surface of the second front flap 4. The support portion 16 comprises two mutual coupling portions 17 positioned at longitudinally opposite end portions of the same support portion 16: the two mutual coupling portions 17 extend symmetrically with respect to a longitudinal development trajectory of the support portion: each mutual coupling portion 17 of the support portion 16 is constrained by adhesive material, in particular it is glued, to at least one between the first front flap 4 and the second coupling portion 14, in particular it is constrained to the inner surface of the second front flap 4. The support portion further comprises a thrust portion 19 emerging from the mutual coupling portion 17 of the same support portion (16), said thrust portion (19) being configured to receive in abutment, to support it, the second coupling portion (14). In greater detail, the mutual coupling portion 17 of the support portion 16 is defined at a bottom area 20 of the support portion 16: the thrust portion 19 is joined in a single piece to said mutual coupling portion 17 and emerges from the bottom portion 20 along the longitudinal development trajectory of the support portion 16 (the longitudinal development trajectory is essentially defined by a centreline of the same support portion 16). In fact, the thrust portion 19 is rotatively movable with respect to the mutual coupling portion 17 of the same support portion 16 for receiving in abutment the hook 22 and allow a rotation thereof with respect to the base body 25.

As previously described for the embodiment of the safety device 12 shown in FIG. 8, the first coupling portion 13 is configured to pass anteriorly to the hook 22 of the second portion 14—during an insertion step preceding the first closed condition—to then traverse said hook 22 and stably engage with the second coupling portion 14. During the insertion step shown in FIG. 8A, the first coupling portion 13 is configured to abut on the hook 22 of the second coupling portion 14 to rotate it and traverse the seat defined between said hook and the base body 25.

The support portion 16 is configured to support the hook during the coupling step between the latter and the hook 23. The support portion 16 comprises a weakening portion 24 configured for enabling the support portion 16 to define at least the following operative conditions:

- a holding operative condition—defined during an initial step of the first closed condition of the first and second front flaps, during which the first coupling portion 13 abuts on the second coupling portion 14—wherein the weakening portion 24 is intact and enables the support portion 16 itself to support the second coupling portion 14, in particular the hook 22, by limiting the movement thereof,
- a releasing operative condition—defined at least during the first closed condition of the first and second front flaps—wherein the weakening portion is broken so that the support portion 16 can enable a movement of the second coupling portion 14, in particular of the hook 22, greater than the movement enabled under the holding operative condition.

The weakening portion 24 is configured for enabling the support portion 16 to switch from the holding condition to the releasing one when the first closed (armed) condition of the first and second front flaps 3, 4 is defined, in other words during the engagement condition of the first and second coupling portions. The support portion 16, during the holding operative condition, exerts a thrust on the second coupling portion 14, in particular on the hook 22, to increase rigidity against flexion. The support portion 16—during the holding operative condition—is configured to receive in abutment at least the hook 22 of the second coupling portion 14, to limit a rotation of said hook 22 approaching the support portion 16 itself. The support portion 16, during the holding operative condition—is configured to allow an angular displacement of the hook 22 of the second coupling portion 14 that is smaller than 90°, in particular contained between 0° and 70°, still more in particular contained between 0° and 45°; said angular displacement is understood as the relative rotation of the hook 22 considered between an initial position of the hook 22—previously the holding operative condition—essentially aligned with the base body 25 and a final position that said hook 22 can assume in the holding operative condition. The support portion 16 is configured to contrast the flexion of at least part of the second coupling portion 14, in particular of the hook 22, during the holding operative condition and hence during the step of engagement between the first and the second coupling portion 13, 14: the support portion 16 is configured to contrast the flexion of the hook 22 (the excessive flexion) of the second coupling portion 14 during the holding operative condition. In yet other words, the support portion 16 essentially prevents the upsetting (total bending) of the hook 22 to assure the correct coupling between the hook 22 of the second coupling portion and the hook 23 of the first coupling portion 13.

The support portion 16, during the release operative condition—is configured to allow an angular displacement of the hook 22 of the second coupling portion 14 that is greater than the angular displacement allowed during the holding operative condition. In the release condition, the support portion allows greater freedom of movement to the hook 22 so that the hook can easily follow the movement of the hook 23 of the first coupling portion 13 and prevent tampering with the envelope 1; the hook 22 is brought to follow the hook 23 and hence brought to maintain the engagement between the first and second coupling portion. If the removable portion 15 is defined by the hook 22 of the second coupling portion 14, the support portion 16 is configured to contact and support said removable portion 15 during the first closed condition of the first and second front flap 3, 4 and hence during the condition of first coupling between the first and second coupling portion; the support portion avoids the excessive bending of the removable portion 15—during the first closed condition of the first and second front flap—and hence the undesired breakage of said portion 15 before the coupling of the first and second coupling portion 13, 14.

The support portion 16 can be joined in a single piece to the second coupling portion 14 (see for example FIG. 3): the second coupling portion 14, the second front flap 4 and the support portion 16 are obtained by folding a single sheet, in particular made of paper material. At least during the first closed condition of the first and second front flap, the second coupling portion 14 is interposed between the second front flap 4 and the support portion 16. The accompanying figures show an envelope in which the first front flap 3, the second front flap 4, the first lateral flap 6, the second lateral flap 7, the first coupling portion 13, the second coupling portion 14, the rear wall 2, are for example joined in a single piece to define a single sheet, in particular a single sheet entirely made of paper material.

Tamper-Evident Band 100

The present invention further relates to a tamper-evident band 100 essentially comprising the rear wall 2, the first front edge 3, the second front flap 4, the first coupling portion 13 and the second coupling portion 14. As shown for example in FIGS. 1 and 2, the band 100 does not comprise the first and the second lateral wall 6, 7.

Unlike the structure of the envelope described above, the rear wall can develop along a non-planar prevalent development surface; the first and the second front flap 3, 4 can be movable with respect to said rear wall 2 optionally along an axis lying on said non planar prevalent development surface of the wall 3.

Figure 2:
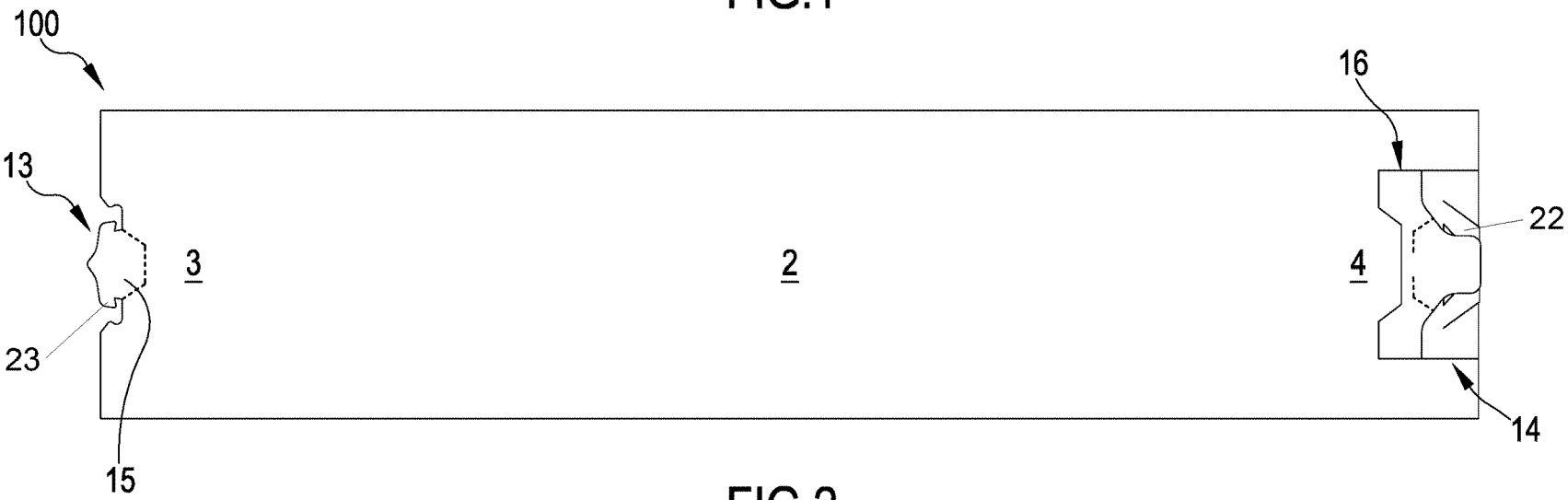
FIG. 2 is a top view of a band in accordance with a second embodiment.
Figure 6:
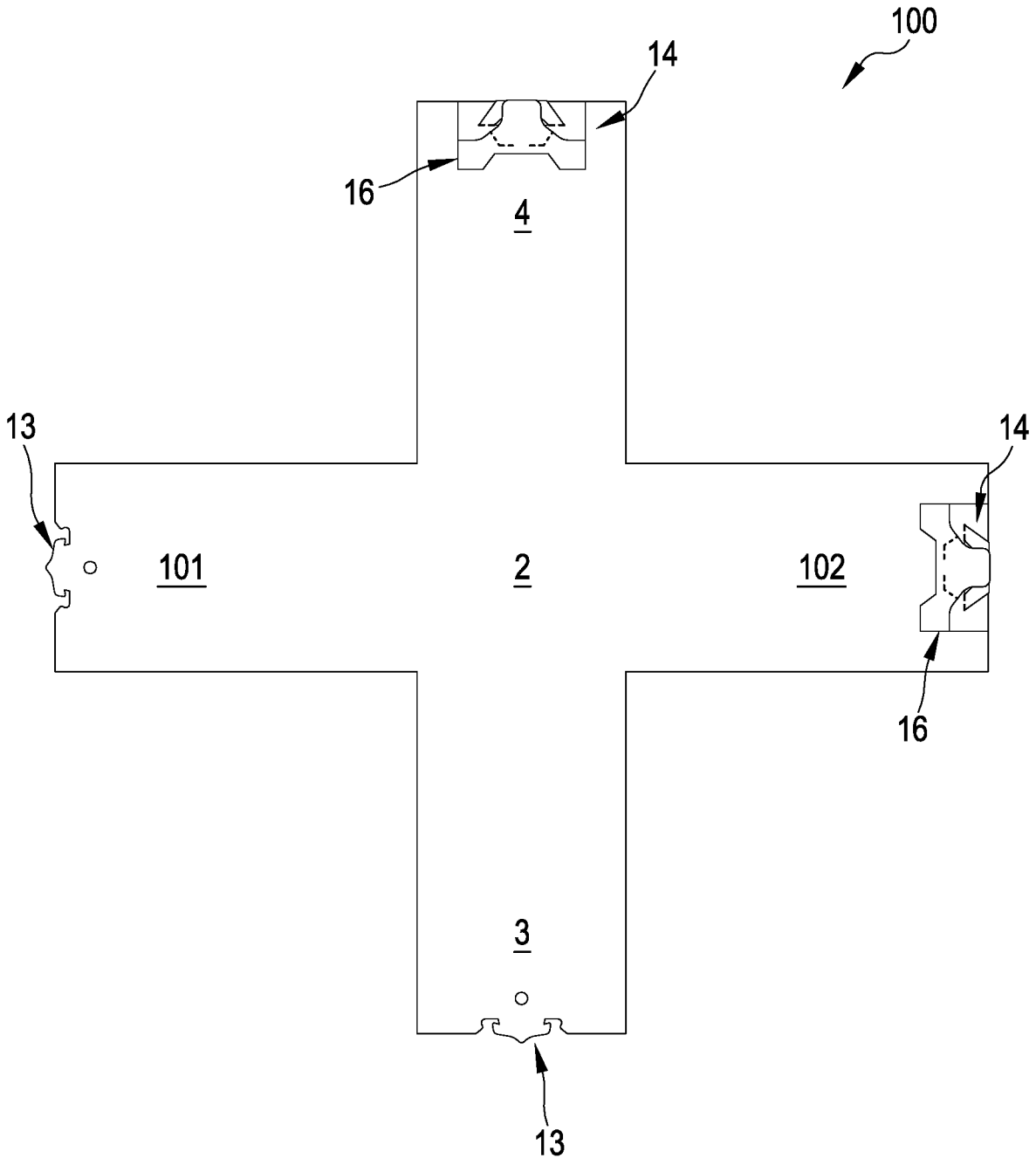
FIG. 6 is a top view of a band in accordance with a third embodiment.
Figure 6A:
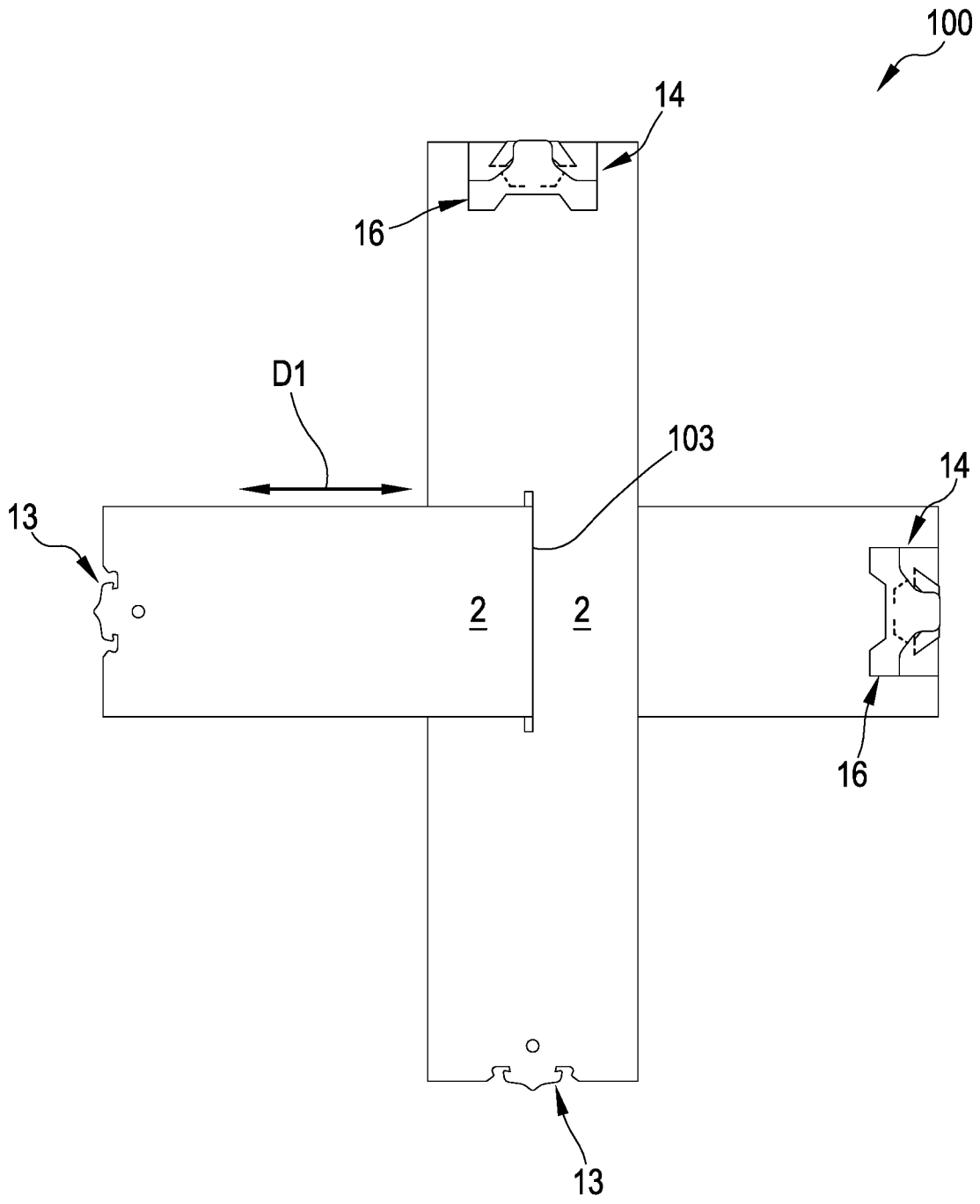
FIG. 6A is a top view of a band in accordance with a fourth embodiment.
Figure 7:
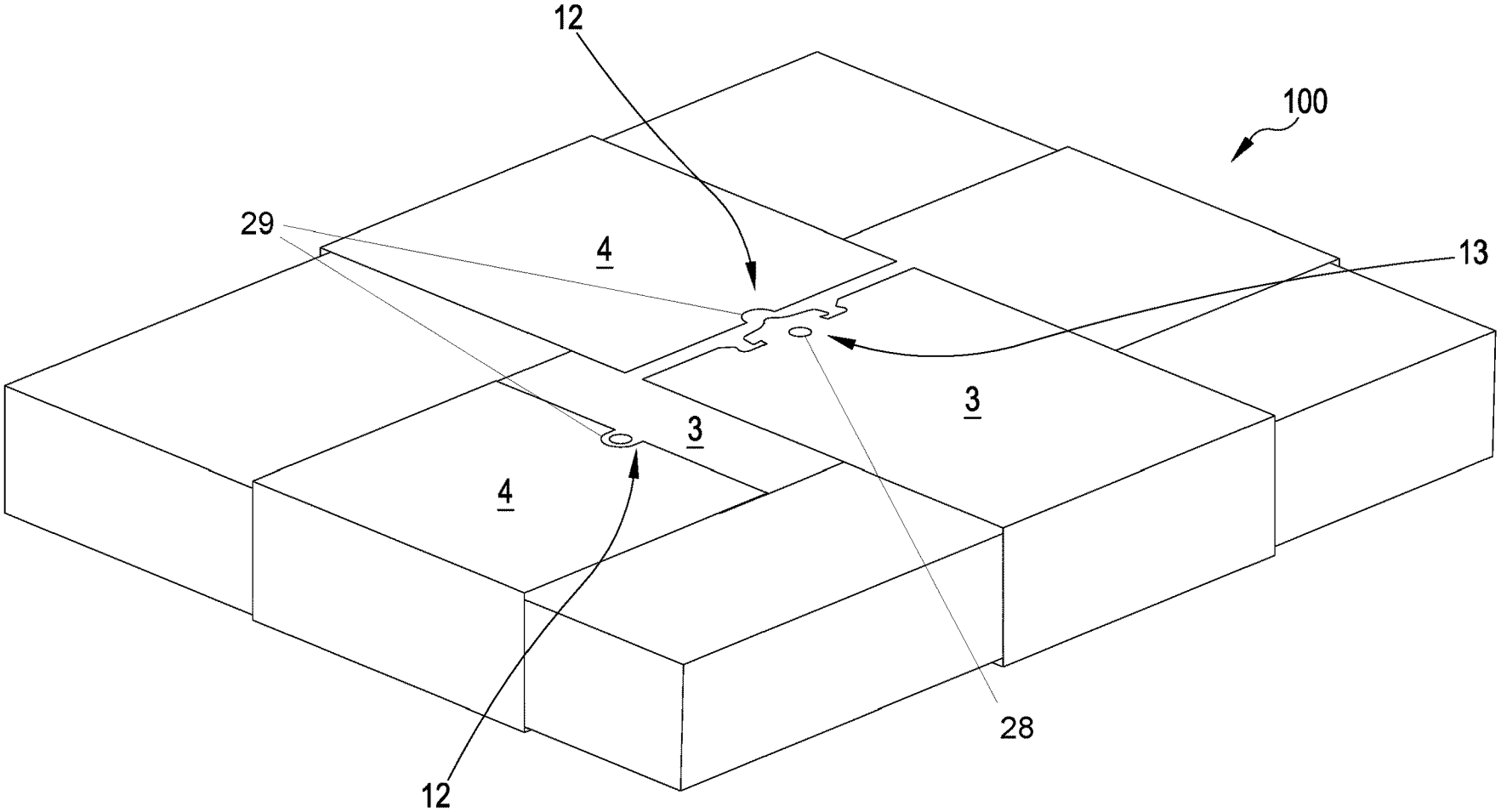
FIG. 7 is a schematic plan view of FIG. 6 during an operative condition in which said band engages a product.

FIG. 6 shows an embodiment variant of said envelope 1 comprising a third and a fourth front flap 101, 102 extending from the rear wall 2 opposing each other and adjacent to the first and second front flap 3, 4; the third and the fourth flap 101, 102 extend along a single prevalent development trajectory that is transverse, optionally orthogonal, to a single prevalent development trajectory along which said first and second front flap 3, 4 extend. The front flaps 3, 4, 101, 102 intersect each other to define a band having an essentially cross-like shape, in particular "+". The third front flap 101 essentially has the same structure of the first flap 3 (flap bearing the first coupling portion 13) while the fourth front flap 102 essentially has the same structure of the second flap 4 (flap bearing the second coupling portion 14). FIG. 6A shows an additional configuration of the band 100 essentially having two bands as shown in FIG. 1 coupled to each other by means of a pocket (slot) 103 with closed profile present on one of said bands: the other band being inserted in the pocket 103 with closed profile and being able to slide with respect to the band having the pocket at least along a direction D1. FIG. 7 schematically shows a possible application of the band 100 (possible applications of the band of FIG. 6 and of FIG. 6A) for wrapping a product.

Process of Manufacturing the Tamper-Evident Envelope 1

The present invention further relates to a process for manufacturing the envelope 1 according to one or more of the accompanying claims and/or as described in detail above. The process comprises at least the steps of:

providing the rear wall 2, providing the first front flap 3, providing the second front flap 4, providing the safety device 12, during which the first coupling portion 13 associated to the first front flap and the second coupling portion associated to the second front flap are formed.

The step of providing the safety device 12 forms on at least one of said coupling portions 13, 14 the removable portion 15 configured for separating from the safety device 12 upon a first open condition of the first and second front flaps after a first closed condition of these latter flaps. The first and the second front flap 3, 4 are joined in a single piece with the rear wall 2; the step of providing the rear wall, the first front flap and the second front flap comprises:

a step of providing a single first sheet, for example made of paper material, according to a planar configuration, a step of notching said first sheet.

The first coupling portion 13 is directly joined in a single piece with the first front flap; the step of providing the first coupling portion 13 comprises the following steps:

providing a second sheet, for example made of paper material, according to a planar configuration, a step of notching said second sheet.

The second coupling portion 14 is directly joined in a single piece with the second front flap; the step of providing the second coupling portion comprises the following steps:

providing a third sheet, for example made of paper material, according to a planar configuration, a step of notching said third sheet, a step of folding the second coupling portion 14 above the second flap 4, optionally, fastening the second portion 14 to the second front flap. Said fastening step can comprise gluing the second portion on the first surface of the rear wall 2.

The process can also comprise the step of providing the support portion 16 which comprises the sub-steps of:

providing an auxiliary sheet, for example made of paper material, according to a planar configuration, joined in a single piece to the third sheet, a step of notching said auxiliary sheet to define said support portion 16, a step of folding the support portion 14 above the second coupling portion 14. The support portion being folded with respect to the second front flap 4 and with respect to the second 14, optionally, fastening the support portion 16 to the second front flap. Said fastening step can comprise gluing the portion 16 on the first surface of the rear wall 2.

If the support portion 16 is present, the process can comprise gluing said portion 16 so that the latter can block the second coupling portion in interposition between the second front flap 4 and the support portion 16 itself. The process can also comprise the step of providing the first and the second lateral flap 6, 7; said step comprises the steps of:

providing a fourth and a fifth sheet, for example made of paper material, according to a planar configuration, notching said fourth and fifth sheet to define respectively the first and second lateral flap.

The first, second, third, fourth and fifth sheet can be joined in a single piece to define a single sheet. The process can then comprise a step of providing a single sheet according to a planar configuration and a single step of said sheet to define a single-sheet blank for the definition of said envelope 100. During the step of cutting the single sheet, the process can concurrently cut the first front flap 3 for obtaining the through opening 28 and cut the second front flap for obtaining the cavity 29. Also concurrently to the step of cutting the individual sheet, the process can comprise making the weakening element 26 to define the removable portion; the weakening element 26 of the first or second coupling portion 13, 14 can comprise at least one of the following steps concurrent to the step of cutting the individual sheet:

one or more cuts through the sheet material, a die-cut of the sheet material, as local compression of the sheet material.

Also concurrently to the step of cutting the individual sheet, the process can comprise making the weakening portion 24 on the support portion 16; said weakening portion can be obtained concurrently with the step of cutting the individual sheet by the following sub-steps:

one or more cuts through the sheet material, a die-cut of the sheet material, as local compression of the sheet material.

Process of Manufacturing the Band 100

The present invention further relates to a process for providing the band 100 as described above. The process comprises the same steps of providing the envelope 1 described above to the exclusion of the steps of providing the first and second lateral flap 6, 7. The process for providing the band 100 can provide additional steps of providing the third and fourth front flap 101, 102: however, said steps are identical to the steps for providing the first and second front flap described above.

Use of the Tamper-Evident Envelope 1

The present invention further relates to a use of the envelope 1 according to one or more of the accompanying claims and/or according to the above description.

In particular, the present invention provides a user of the envelope 1 for containing and one or more products; said use comprising at least the following steps:

arranging at least said first and second front flap in the open condition, providing one or more products at, in particular above, the rear wall 2, defining the first closed condition of the first and second front flap so as to define the engagement of the first and second coupling portion of the safety device 12.

If the first and second lateral flaps 6, 7 are present, the method further comprises the following steps:

following the positioning of at least one product on the rear wall 2, positioning the first and the second lateral flap 6, 7 above said at least one product, following the positioning of the first and second lateral flap 6, 7 above the at least one product, defining the first closed condition of the first and second front flap so as to define the engagement of the first and second coupling portion of the safety device 12.

Following the first closed condition of the envelope 1, the first and second lateral flap 6, 7 are interposed between the at least one product and the first and second front flap 3, 4. The envelope can be used for containing one or more products comprising—without limitation—at least one selected in the group of: letters, documents made of sheet material, for example paper.

The invention claimed is:

1. A tamper-evident envelope of sheet material, comprising:

at least one rear wall, at least one first front flap engaged with the rear wall, at least one second front flap also engaged with the rear wall opposite to said first front flap, wherein the first and second front flaps are configured for defining at least one closed condition wherein these latter at least partially overlap each other, wherein the first and second front flaps are further configured for defining at least one open condition, wherein these latter are distanced from each other, said envelope further comprising at least one safety device of sheet material, said safety device comprising:

at least one first coupling portion borne by the first front flap, at least one second coupling portion borne by the second front flap, the first and second coupling portions being configured for stably engaging with each other during a first closed condition of the first and second front flaps, at least one between the first and second coupling portions exhibiting at least one removable portion configured for separating from at least one between the first and second front flap after a first opening condition thereof subsequent to said first closed condition for preventing a subsequent coupling of said first and second coupling portions and for revealing tampering with the envelope, a through opening defined on the first front flap which is configured—under the first closed condition of the first and second front flaps—for enabling to display the removable portion.

2. The envelope according to claim 1, wherein at least one between said first and second front flaps is rotatively movable with respect to the rear wall at least between:

the closed condition wherein the at least one between said first and second front flaps substantially faces the rear wall, the open condition wherein the at least one between said first and second front flaps is distanced from the other between said second and first front flaps.

3. The envelope according to claim 1, wherein the rear wall substantially extends along a prevalent development plane, wherein the at least one between said first and second front flaps is rotatively movable with respect to the rear wall about an axis lying in the prevalent development plane of the rear wall.

4. The envelope according to claim 1, wherein the rear wall of sheet material extends in thickness between a first and second surface, wherein the first and second front flaps—under the closed condition—both face the first surface of the rear wall, wherein under the closed condition, the first surface of the rear wall substantially defines an internal surface of the envelope, while the second surface defines an external surface of the envelope.

5. The envelope according to claim 1, wherein the first front flap extends from the rear wall starting from a perimetral edge of this latter wall to a top portion of the first front flap distanced from said perimetral edge, wherein the first coupling portion is positioned at said top portion of the first flap, wherein said first coupling portion defines part of an external delimiting perimeter of the first front flap, wherein the second front flap extends from the rear wall starting from the perimetral edge of this latter wall to a top portion of the second front flap distanced from said perimetral edge, wherein the second coupling portion is positioned at said top portion of the second flap, wherein, in the first closed condition of the first and second front flaps, the respective top portions of said front flaps are configured for overlapping each other and enabling the engagement of the first and second coupling portions.

6. The envelope according to claim 1, wherein the second coupling portion faces and is at least partially in contact with the second front flap, wherein the second coupling portion overlaps the second front flap.

7. The envelope according to claim 1, wherein the second front flap of sheet material extends in thickness between a first and second surface, wherein the second coupling portion is at least partly glued to the first surface of the second front flap at the top portion thereof.

8. The envelope according to claim 1 further comprising:

at least one first lateral flap engaged with the rear wall at the perimetral edge thereof, adjacent between the first and second front flaps, at least one second lateral flap engaged with the rear wall at the perimetral edge thereof opposite to the first lateral flap and adjacent the first and second front flaps, wherein the first and second lateral flaps are configured for being interposed—in the closed condition of the first and second front—between the real wall and said first and second front flaps.

9. The envelope according to claim 8, wherein the rear wall exhibits a square or rectangular shape, the perimetral edge of the rear wall being defined by a first and second longitudinal edges distanced and parallel to each other, which are connected to a first and second transversal edges, said first and second transversal edges being also distanced and parallel to each other, wherein the first front flap is integral with the first transverse edge, while the second front flap is connected to the second transverse edge, wherein the first lateral flap is connected to the first longitudinal flap while the second lateral flap is connected to the second longitudinal edge, at least one between said first and second lateral flaps being rotatively movable with respect to the rear wall about an axis lying in the prevalent development plane of the rear wall.

10. The envelope according to claim 1, wherein the first coupling portion—at least under the closed condition of the first and second front flaps—is at least partially interposed between the second coupling portion and said second front flap.

11. The envelope according to claim 1, wherein the second coupling portion comprises at least one hook defining at least one undercut portion delimited by a gripping edge, wherein the first coupling portion comprises at least one respective hook defining at least one undercut portion delimited by a respective gripping edge, said hooks, respectively of the first and second coupling portions, being configured for stably engaging with each other at least during the first closed condition of the first and second front flaps, said hooks—under the first closed condition of the first and second front flaps—exhibiting respective mutually facing concavities, wherein the removable portion is defined by at least a part of the hook of the second coupling portion.

12. The envelope according to claim 11, wherein the second coupling portion comprises a base body which directly bears the hook of the same second coupling portion, said hook of the second coupling portion being rotatively movable with respect to said base body, the base body and the hook of the second coupling portion being overlapped to the second front flap, exclusively the base body of the second coupling portion being directly constrained by gluing to the second front flap.

13. The envelope according to claim 1 comprising at least one support portion directly constrained to at least one between the second front flap and the second coupling portion, wherein the support portion is configured—at least during an initial contact step between the first and second coupling portions before said first closed condition of the first and second front flaps— for supporting at least part of said second coupling portion, wherein the support portion comprises a weakening portion configured for enabling the support portion to define at least the following operative conditions:

a holding operative condition—defined during an initial step of the first closed condition of the first and second front flaps, during which the first coupling portion abuts on the second coupling portion—wherein the weakening portion is intact and enables the support portion itself to support the second coupling portion by limiting the movement thereof, a releasing operative condition—defined at least during the first closed condition of the first and second front flaps—wherein the weakening portion is broken so that the support portion can enable a movement of the second coupling portion greater than the movement enabled under the holding operative condition, said weakening portion being configured for enabling the support portion to switch from the holding condition to the releasing one when the first closed condition of the first and second front flaps is defined and during the engagement condition of the first and second coupling portions.

14. A tamper-evident envelope of sheet material, comprising:

at least one rear wall, at least one first front flap engaged with the rear wall, at least one second front flap also engaged with the rear wall opposite to said first front flap, wherein the first and second front flaps are configured for defining at least one closed condition wherein these latter at least partially overlap each other, wherein the first and second front flaps are further configured for defining at least one open condition, wherein these latter are distanced from each other, said envelope further comprising at least one safety device of sheet material, said safety device comprising:

at least one first coupling portion borne by the first front flap, at least one second coupling portion borne by the second front flap, the first and second coupling portions being configured for stably engaging with each other during a first closed condition of the first and second front flaps, at least one between the first and second coupling portions exhibiting at least one removable portion configured for separating from at least one between the first and second front flap after a first opening condition thereof subsequent to said first closed condition for preventing a subsequent coupling of said first and second coupling portions and for revealing tampering with the envelope, at least one support portion directly constrained to at least one between the second front flap and the second coupling portion, wherein the support portion is configured—at least during an initial contact step between the first and second coupling portions before said first closed condition of the first and second front flaps—for supporting at least part of said second coupling portion, wherein the support portion comprises a weakening portion configured for enabling the support portion to define at least the following operative conditions:

a holding operative condition—defined during an initial step of the first closed condition of the first and second front flaps, during which the first coupling portion abuts on the second coupling portion—wherein the weakening portion is intact and enables the support portion itself to support the second coupling portion by limiting the movement thereof, a releasing operative condition—defined at least during the first closed condition of the first and second front flaps—wherein the weakening portion is broken so that the support portion can enable a movement of the second coupling portion greater than the movement enabled under the holding operative condition, said weakening portion being configured for enabling the support portion to switch from the holding condition to the releasing one when the first closed condition of the first and second front flaps is defined and during the engagement condition of the first and second coupling portions.

15. The envelope according to claim 14, comprising at least one of:

a through opening defined on the first front flap which is configured—under the first closed condition of the first and second front flaps—for enabling to display the removable portion, a cavity defined on the second front flap which is configured—under the first closed condition of the first and second front flaps—for enabling to display the removable portion.

16. The envelope according to claim 14, wherein the second coupling portion comprises a base body which directly bears the hook of the same second coupling portion, said hook of the second coupling portion being rotatively movable with respect to said base body, the base body and the hook of the second coupling portion being overlapped to the second front flap, exclusively the base body of the second coupling portion being directly constrained by gluing to the second front flap.

17. A tamper-evident envelope of sheet material, comprising:

at least one rear wall, at least one first front flap engaged with the rear wall, at least one second front flap also engaged with the rear wall opposite to said first front flap, wherein the first and second front flaps are configured for defining at least one closed condition wherein these latter at least partially overlap each other, wherein the first and second front flaps are further configured for defining at least one open condition, wherein these latter are distanced from each other, said envelope further comprising at least one safety device of sheet material, said safety device comprising:

at least one first coupling portion borne by the first front flap, at least one second coupling portion borne by the second front flap, the first and second coupling portions being configured for stably engaging with each other during a first closed condition of the first and second front flaps, at least one between the first and second coupling portions exhibiting at least one removable portion configured for separating from at least one between the first and second front flap after a first opening condition thereof subsequent to said first closed condition for preventing a subsequent coupling of said first and second coupling portions and for revealing tampering with the envelope, wherein the second coupling portion comprises at least one hook defining at least one undercut portion delimited by a gripping edge, wherein the first coupling portion comprises at least one respective hook defining at least one undercut portion delimited by a respective gripping edge, said hooks, respectively of the first and second coupling portions, being configured for stably engaging with each other at least during the first closed condition of the first and second front flaps, said hooks—under the first closed condition of the first and second front flaps—exhibiting respective mutually facing concavities, wherein the removable portion is defined by at least a part of the hook of the second coupling portion.

18. The envelope according to claim 17, wherein the second coupling portion comprises a base body which directly bears the hook of the same second coupling portion, said hook of the second coupling portion being rotatively movable with respect to said base body, the base body and the hook of the second coupling portion being overlapped to the second front flap, exclusively the base body of the second coupling portion being directly constrained by gluing to the second front flap.

* * * * *